US010564577B2

(12) United States Patent
Yabuki

(10) Patent No.: US 10,564,577 B2
(45) Date of Patent: Feb. 18, 2020

(54) FIXING DEVICE AND IMAGE FORMING APPARATUS

(71) Applicant: Konica Minolta, Inc., Tokyo (JP)

(72) Inventor: Shinichi Yabuki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/241,520

(22) Filed: Jan. 7, 2019

(65) Prior Publication Data

US 2019/0235422 A1 Aug. 1, 2019

(30) Foreign Application Priority Data

Jan. 31, 2018 (JP) ..... 2018-014830

(51) Int. Cl.
*G03G 15/20* (2006.01)

(52) U.S. Cl.
CPC ..... *G03G 15/2028* (2013.01); *G03G 15/2053* (2013.01); *G03G 15/2064* (2013.01); *G03G 2215/2035* (2013.01); *G03G 2215/2038* (2013.01)

(58) Field of Classification Search
CPC ..... G03G 15/2028; G03G 15/2064; G03G 2215/2035
See application file for complete search history.

(56) References Cited

U.S. PATENT DOCUMENTS

2009/0052925 A1* 2/2009 Fujimoto ..... G03G 15/206 399/67
2010/0260524 A1* 10/2010 Hiraoka ..... G03G 15/2053 399/329
2010/0290822 A1* 11/2010 Hasegawa ..... G03G 15/2064 399/329
2015/0055994 A1* 2/2015 Shoji ..... G03G 15/2053 399/329

FOREIGN PATENT DOCUMENTS

JP 2014112144 A 6/2014

* cited by examiner

*Primary Examiner* — Sandra Brase
(74) *Attorney, Agent, or Firm* — Lucas & Mercanti, LLP

(57) ABSTRACT

A fixing device fixes a toner image onto a recording material by applying heat and pressure to the toner image formed on the recording material at a nip provided in a conveyance path of the recording material, and includes: a heating source; a pressure roller and a pressure pad; and a sandwiching member, wherein the pressure pad includes a first main surface and a second main surface, and the first main surface is formed of a long plate-like member, the sandwiching member includes a long plate-like abutting part, and a width-direction center in an area included in the second main surface and corresponding to a recording material passing region provided in the nip bulges toward the abutting part side more than width-direction both ends of the area included in the second main surface and corresponding to the recording material passing region provided in the nip.

15 Claims, 18 Drawing Sheets

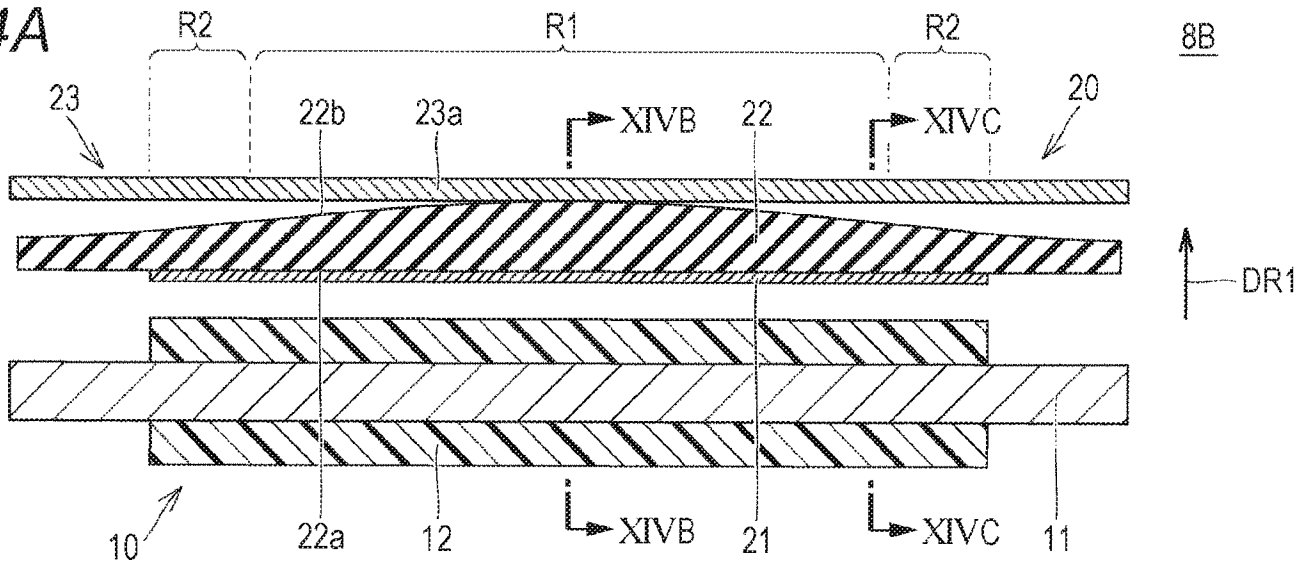
FIG. 14A
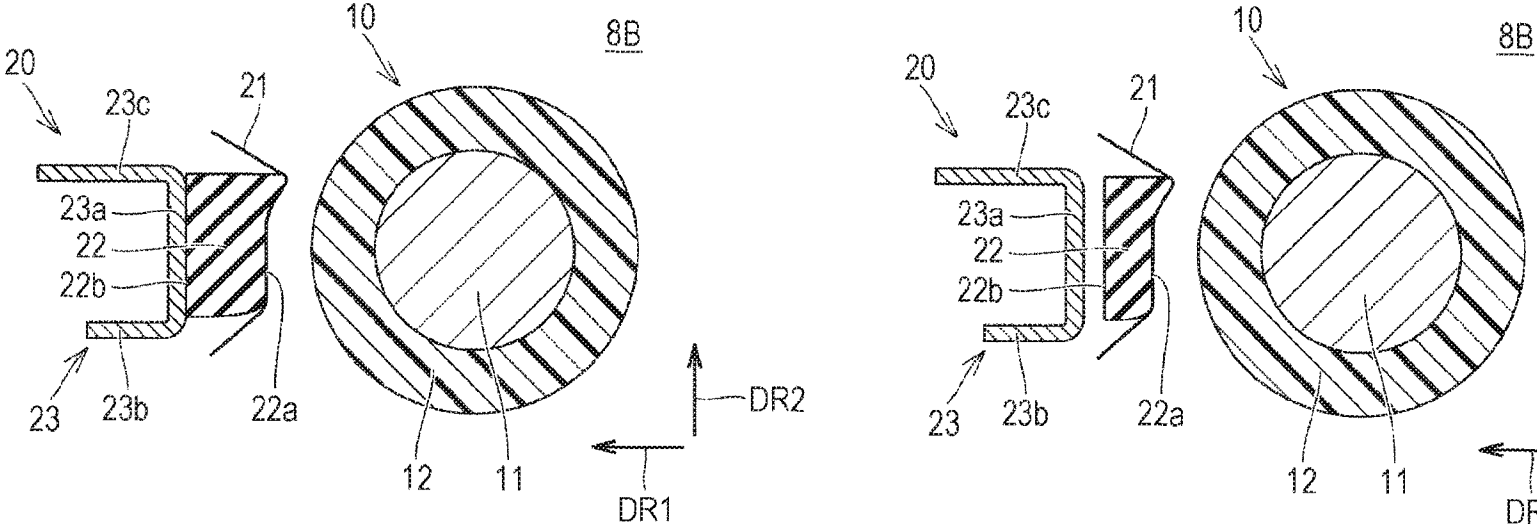
FIG. 14C
FIG. 14B

FIXING DEVICE AND IMAGE FORMING APPARATUS

The entire disclosure of Japanese patent Application No. 2018-014830, filed on Jan. 31, 2018, is incorporated herein by reference in its entirety.

BACKGROUND

Technological Field

The present invention relates to a fixing device that fixes, onto a recording material, a toner image formed on the recording material like a paper sheet, and also relates to an image forming apparatus such as a copy machine, a printer, or a facsimile machine including the fixing device in an image former that forms an image by utilizing an electrographic system regardless of a type such as color/monochrome.

Description of the Related Art

In an electrophotographic image forming apparatus, a fixing device of a heat fixing system is generally provided. Normally, the fixing device of the heat fixing system has a pressing rotator and a heating rotator, and a toner image is fixed onto a recording material by sandwiching, between the pressing rotator and the heating rotator, the recording material on which the toner image is formed.

For example, JP 2014-112144 A discloses a fixing device in which a pressure roller is used as a pressing rotator and an endless fixing belt is used as a heating rotator. In fixing device, a pad-like fixing member is arranged in a manner facing the pressing rotator so as to sandwich a fixing belt therebetween, and the fixing belt is pressed against the fixing member by the pressure roller during fixing operation.

Consequently, a nip is formed between the pressure roller and the fixing member (more specifically, between the pressure roller and the fixing belt arranged between the pressure roller and the fixing member) during fixing operation, and also the pressure roller is rotationally driven in a state in which the fixing belt is pressed against the fixing member by the pressure roller, thereby driving and rotating the fixing belt along with rotation of the pressure roller.

As a result, when the recording material is fed to the nip and passes through the nip, and a toner image formed on the recording material is applied with heat and pressure at the nip, thereby fixing the toner image on the recording material.

Here, it is necessary to appropriately control pressure applied to the recording material at a nip of a fixing device in order to improve quality of an image formed on a recording material by an image forming apparatus. Particularly, in a case where fixing unevenness occurs during fixing operation, the quality of the image formed on the recording material also become uneven, and therefore, it may be important to suppress occurrence of such fixing unevenness as much as possible.

To suppress occurrence of such fixing unevenness relative to a toner image formed on a recording material, it is effective to substantially uniformly apply pressure to the recording material along a width direction of a fixing belt (namely, an axial direction of a pressure roller), and a design in consideration of deflection of the pressure roller and deflection of a fixing member during fixing operation may be indispensable.

In this regard, the fixing device disclosed in JP 2014-112144 A has a structure in which deflection of a fixing member can be suppressed by providing a plate-like reinforcing member that is made of a metallic material and supports a rear surface side of the fixing member (in other words, opposite side of a side where a pressure roller is located when viewed from the fixing member) in order to suppress deflection of the fixing member which may occur when pressed by the pressure roller.

However, since pressing force of the pressure roller is extremely strong, it is difficult to completely eliminate deflection of the fixing member even in the case of installing the plate-like reinforcing member made of the metallic material, and the reinforcing member may also be deflected to a considerable extent. To completely eliminate deflection of the fixing member by preventing deflection of the reinforcing member, it is necessary to use a material having an extremely large thickness as the reinforcing member.

On the other hand, it is preferable to minimize heat capacity of each of members constituting the fixing device from the viewpoint of energy saving, and in the case of providing the reinforcing member as disclosed in JP 2014-112144 A, it is necessary to sufficiently reduce heat capacity of the reinforcing member as well. Therefore, in the case of forming the reinforcing member to have a large thickness in order to completely eliminate deflection of the fixing member as described above, there may be a problem that a goal of energy saving cannot be achieved because heat capacity as a whole fixing device is largely increased.

SUMMARY

Therefore, an object of the present invention is to provide: a fixing device capable of suppressing occurrence of unevenness in an image formed on a recording material while saving energy; and an image forming apparatus including the same.

To achieve the abovementioned object, according to an aspect of the present invention, there is provided a fixing device that fixes a toner image onto a recording material by applying heat and pressure to the toner image formed on the recording material at a nip provided in a conveyance path of the recording material, and the fixing device reflecting one aspect of the present invention comprises: a heating source that heats a toner image formed on a recording material; a pressure roller and a pressure pad arranged in a manner facing each other while interposing the conveyance path so as to form the nip; and a sandwiching member arranged on an opposite side of a side where the pressure roller is located when viewed from the pressure pad, and used to sandwich the pressure pad with the pressure roller in a pressed state in which the pressure pad is pressed by the pressure roller, wherein the pressure pad includes a first main surface located on the pressure roller side and a second main surface located on the sandwiching member side, and the first main surface is formed of a long plate-like member extending along a width direction that is a direction parallel to an axial direction of the pressure roller, the sandwiching member includes a long plate-like abutting part that extends along the width direction and abuts on the pressure pad in the pressed state, and a width-direction center in an area included in the second main surface and corresponding to a recording material passing region provided in the nip bulges toward the abutting part side more than width-direction both ends of the area included in the second main surface and corresponding to the recording material passing region provided in the nip.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 14A to 14C are schematic cross-sectional views illustrating a state of the fixing device according to a second embodiment during a standby period;

DETAILED DESCRIPTION OF EMBODIMENTS

Figure 1:
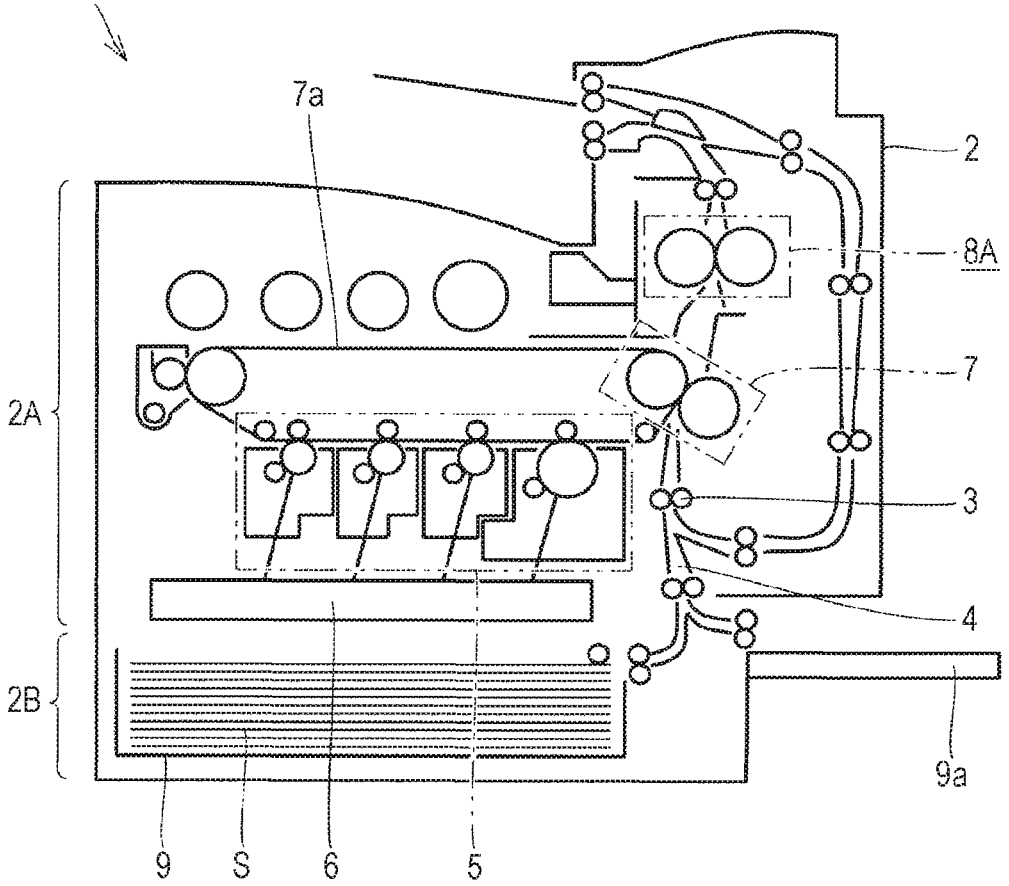
FIG. 1 is a schematic view illustrating an image forming apparatus according to a first embodiment.

Hereinafter, one or more embodiments of the present invention will be described in detail with reference to the drawings. However, the scope of the invention is not limited to the disclosed embodiments. In the embodiments described below, the description will be provided by exemplifying a so-called tandem-type color printer employing an electrophotographic system and a fixing device provided therein as an image forming apparatus and a fixing device to which the present invention is applied. Note that, in the following embodiments, same or common members will be denoted by the same reference signs in the drawings and descriptions thereof will not be repeated.

First Embodiment

FIG. 1 is a schematic view of an image forming apparatus according to a first embodiment. First, a schematic structure and operation of an image forming apparatus 1 according to the present embodiment will be described with reference to this FIG. 1.

As illustrated in FIG. 1, the image forming apparatus 1 mainly includes an apparatus body 2 and a sheet feeding unit 9. The apparatus body 2 includes: an image former 2A that is a part to form an image on a sheet S provided as a recording material; and a sheet feeder 2B that is a part to feed a sheet S to the image former 2A. The sheet feeding unit 9 is used to store sheets S to be fed to the image former 2A, and is provided detachably from the sheet feeder 2B.

A plurality of rollers 3 is installed inside the image forming apparatus 1, and a conveyance path 4 where a sheet S is conveyed along a predetermined direction by these rollers is built across the image former 2A and the sheet feeder 2B. Additionally, as illustrated in FIG. 1, a manual feed tray 9*a* to feed a sheet S to the image former 2A may also be separately provided in the apparatus body 2.

The image former 2A mainly includes: an image forming unit 5 capable of forming toner images of respective colors of, for example, yellow (Y), magenta (M), cyan (C), and black (K); an exposure unit 6 to expose photoreceptors included in the image forming unit 5; an intermediate transfer belt 7*a* stretched around the image forming unit 5; a transfer member 7 provided on the conveyance path 4 and also on a travel route of the intermediate transfer belt 7*a*; and a fixing device 8A according to the present embodiment provided on the conveyance path 4 of an area located more on a downstream side than the transfer member 7 is.

The image forming unit 5 forms, on a surface of each of photoreceptors, each of toner images of yellow (Y), magenta (M), cyan (C), and black (K) or a toner image formed only of black (K) in response to exposure from the exposure unit 6, and transfers the toner images to the intermediate transfer belt 7*a* (so-called primary transfer). Consequently, a color toner image or a monochrome toner image is formed on the intermediate transfer belt 7*a*.

The intermediate transfer belt 7*a* transfers the color toner image or the monochrome toner image formed on the surface thereof to the transfer member 7, and in the transfer member 7, the image is subject to press-contacting together with a sheet S conveyed from the sheet feeder 2B to the transfer member 7. Consequently, the color toner image or the monochrome toner image formed on the surface of the intermediate transfer belt 7*a* is transferred onto the sheet S (so-called secondary transfer).

After that, the sheet S to which the color toner image or the monochrome toner image has been transferred is pressed and heated by the fixing device 8A. Consequently, a color image or a monochrome image is formed on the sheet S, and the sheet S on which the color image or the monochrome image is formed is ejected from the apparatus body 2.

Figure 2:
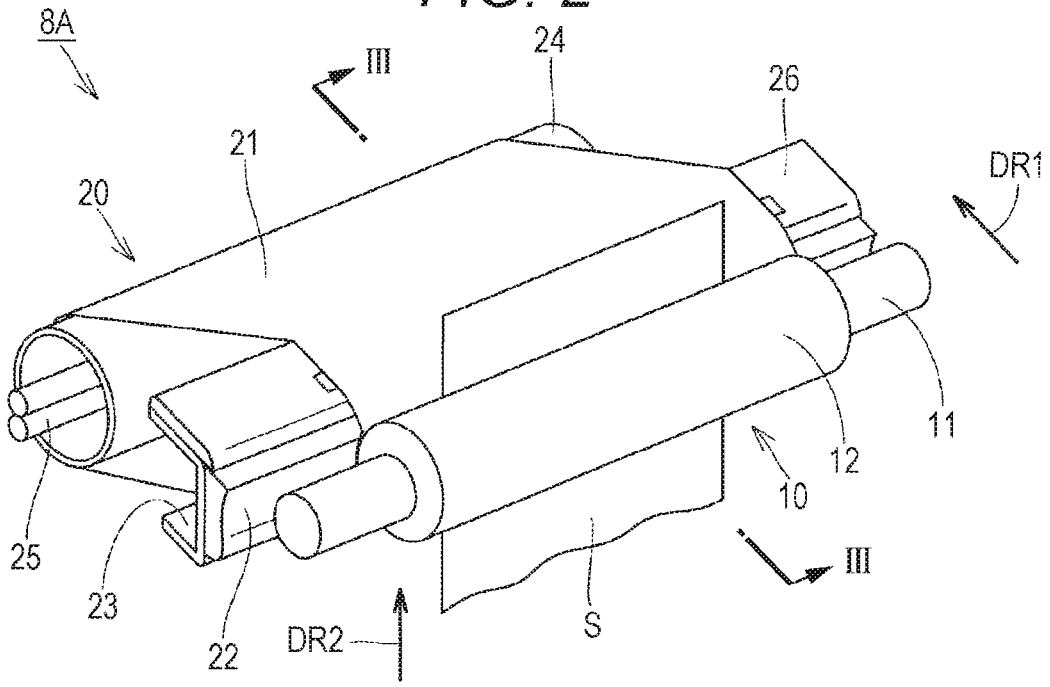
FIG. 2 is a schematic perspective view of a fixing device according to the first embodiment.
Figure 3:
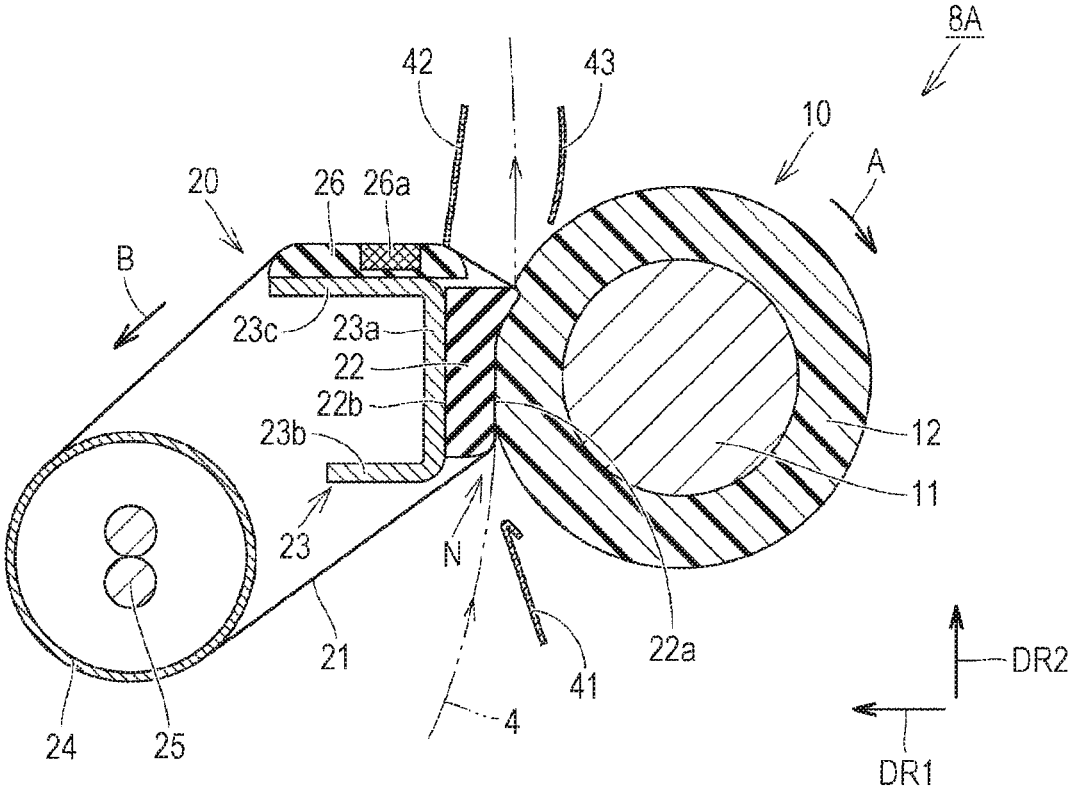
FIG. 3 is a schematic cross-sectional view of the fixing device illustrated in FIG. 2.
Figure 4:
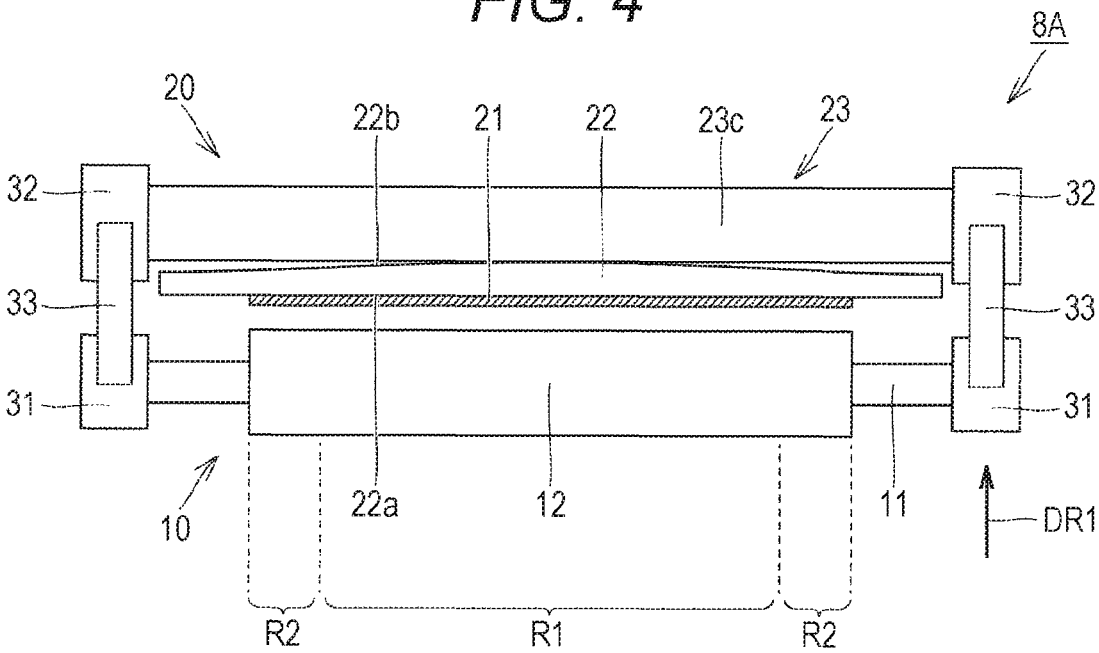
FIG. 4 is a schematic plan view of the fixing device illustrated in FIG. 2.

FIG. 2 is a schematic perspective view of the fixing device according to the present embodiment. Additionally, FIG. 3 is a schematic cross-sectional view of the fixing device illustrated in FIG. 2 taken along a line III-III in FIG. 2, and FIG. 4 is a schematic plan view of the fixing device illustrated in FIG. 2. In the following, a structure and operation of the fixing device 8A according to the present embodiment will be described with reference to FIGS. 2 to 4. Note that FIGS. 2 and 3 illustrate a state of the fixing device 8A during fixing operation, and FIG. 4 illustrates a state of the fixing device 8A during a standby period (during non-fixing operation).

As illustrated in FIGS. 2 to 4, the fixing device 8A mainly includes: a pressure roller 10 as a pressing rotator; a fixing belt unit 20 including a fixing belt 21 as a heating rotator; a first chassis 31 and a second chassis 32 (refer to FIG. 4 for both members); a pair of biasing members 33 (refer to FIG. 4); and various guides 41 to 43 (refer to FIG. 3) to guide conveyance of a sheet S.

The pressure roller 10 includes: a core metal 11 made of, for example, an aluminum alloy or iron; and an elastic layer 12 provided in a manner covering the metal core 11 and made of rubber such as silicone rubber or fluorine rubber. The pressure roller 10 may further include a release layer provided in a manner covering the elastic layer 12 and made of a fluorine series resin or the like.

Various kinds of shapes such as a solid columnar shape or a hollow cylindrical shape can be used for the core metal 11, and an outer diameter thereof is not particularly limited, but is set to, for example, 20 mm or more and 100 mm or less. A thickness of the elastic layer 12 and a thickness of the release layer are also not particularly limited, but the thickness of the elastic layer 12 is set to, for example, 1 mm or more and 20 mm or less, and the thickness of the release layer is set to, for example, 5 μm or more and 100 μm or less.

The pressure roller 10 is arranged in a manner facing an outer peripheral surface of the fixing belt 21, and axial both ends of the pressure roller 10 are rotatably supported by shaft supports provided at the first chassis 31. The pressure roller 10 is rotationally driven by a drive source such as a motor (not illustrated). Additionally, the pressure roller 10 is able to perform elastic biasing toward the fixing belt unit 20 side by using the pair of biasing members 33.

The fixing belt unit 20 mainly includes a pressure pad 22, a sandwiching member 23, a heating roller 24, a heating source 25, and an auxiliary pad 26 in addition to the above-described fixing belt 21. Note that, in FIG. 4, a part of the fixing belt 21, the heating roller 24, the heating source 25, and the auxiliary pad 26 are omitted and not illustrated.

The fixing belt 21 has an endless shape and is formed of, for example, a plurality of layers in consideration of heat resistance, strength, surface smoothness, and the like. Specifically, the fixing belt 21 includes, for example: a base material layer made of, for example, a polyimide resin, a stainless alloy, electroformed nickel, or the like; a rubber elastic layer made of, for example, silicone rubber or fluorine rubber; and a release layer made of, for example, a fluorine series resin or the like. The plurality of layers is sequentially positioned in order of the base material layer, the elastic layer, and the release layer from the inside to the outside of the fixing belt 21.

An outer diameter (i.e., outer peripheral length) of the fixing belt 21 is not particularly limited, but is to be, for example, 10 mm or more and 100 mm or less. A thickness of the base material layer, a thickness of the elastic layer, and a thickness of the release layer are also not particularly limited, but the thickness of the base material layer is set to, for example, 5 μm or more and 100 μm or less, and the thickness of the elastic layer is set to, for example, 10 μm or more and 300 μm or less, and the thickness of the release layer is set to, for example, 5 μm or more and 100 μm or less.

The pressure pad 22 is formed of a long plate-like member extending along a width direction of the fixing belt 21 (that is, axial direction of the pressure roller 10), and a large part thereof is arranged in a space on an inner side of the fixing belt 21. With this structure, the pressure pad 22 faces an inner peripheral surface of the fixing belt 21 so as to face the pressure roller 10 while interposing the fixing belt 21. The pressure pad 22 includes: a first main surface 22*a* located on the pressure roller 10 side and a second main surface 22*b* located on an opposite side of the pressure roller 10 side (i.e., sandwiching member 23 side).

The pressure pad 22 is formed of a resin member made of, for example, a polyphenylene sulfide resin, a polyimide resin, a liquid crystal polymer resin, or the like, or formed of a metal member made of an aluminum alloy, iron, or the like. Additionally, the pressure pad 22 may also be formed of a composite component including: any one of the above-described members; and a rubber member made of, for example, silicone rubber or fluororubber.

The sandwiching member 23 is formed of a long plate-like member extending along the width direction of the fixing belt 21 and a large part thereof is arranged in the space on the inner side of the fixing belt 21 so as to be located on an opposite side of a side where the pressure roller 10 is located when viewed from the pressure pad 22. The sandwiching member 23 supports the pressure pad 22 and also reinforces the pressure pad 22.

The sandwiching member 23 has a substantially C-shaped cross section including: a flat plate-like abutting part 23*a* facing the second main surface 22*b* of the pressure pad 22; and a pair of flat plate-like standing walls 23*b* and 23*c* standing from the abutting part 23*a* toward an opposite side of the side where the pressure roller 10 is located. Meanwhile, among the pair of standing walls 23*b* and 23*c*, the standing wall 23*b* stands from an end of the abutting part 23*a* corresponding to an upstream position in a conveyance direction DR2 of a sheet S described later, and the standing wall 23*c* stands from the other end of the abutting part 23*a* corresponding to a downstream position in the conveyance direction DR2 of a sheet S.

The sandwiching member 23 is formed of a metallic member such as electrogalvanized steel plate (SECC). The sandwiching member 23 is fixed to the second chassis 32 by having width-direction both ends thereof supported by the second chassis 32. Note that a hook-shaped locking part or the like (not illustrated) is provided at a periphery of the pressure pad 22, and the pressure pad 22 is attached in a state loosely held by the sandwiching member 23 by the locking part being locked with a peripheral edge and the like of the abutting part 23*a* of the sandwiching member 23.

The heating roller 24 is formed of a cylindrical member extending along the width direction of the fixing belt 21 and a large part of thereof is arranged in the space on the inner side of the fixing belt 21 so as to be located on the opposite side of the side where the pressure roller 10 is located when viewed from the sandwiching member 23. With this structure, an outer peripheral surface of the heating roller 24 faces the inner peripheral surface of the fixing belt 21. The heating roller 24 is used to transfer, to the fixing belt 21, heat generated by the heating source 25. The heating roller 24 has axial both ends rotatably supported by shaft supports (not illustrated).

The heating roller 24 is formed of a metal hollow cylindrical member made of, for example, an aluminum alloy or the like. An outer diameter of the heating roller 24 is not particularly limited, but is set to, for example, 10 mm or more and 100 mm or less. Note that it is preferable that an inner peripheral surface of the heating roller 24 be covered with a black layer in order to perform efficient heat transfer, and also an outer peripheral surface thereof may be covered with a protective layer made of a fluorine series resin or the like.

The heating source 25 includes a pair of rod-shaped heaters including a long heater and a short heater extending along a direction parallel to the width direction of the fixing belt 21, and is arranged in a space on an inner side of the heating roller 24. The heating source 25 is adapted to heat the fixing belt 21 via the heating roller 24, and has axial both ends held by holders (not illustrated). Both of the long heater and the short heater are, for example, all formed of halogen heaters.

The long heater has a heat generator in a region corresponding to a substantially entire region in the width direction of the fixing belt 21, and when the heat generator generates heat, the fixing belt 21 is heated mainly by radiant heat thereof via the heating roller 24. Note that an axial length of the heat generator corresponds to a width of a sheet with a maximum width among sheets with various sizes fed to the image forming apparatus 1. Additionally, the axial length of the heat generator of the long heater substantially corresponds to a width of a sheet passing region R1 (refer to FIG. 4) as a passing region of a sheet S that passes through a nip N described later.

The short heater has a heat generator only in a region corresponding to a width-direction center of the fixing belt 21, and when the heat generator generates heat, the short heater mainly heats the fixing belt 21 with radiant heat thereof via the heating roller 24. Note that an axial length of the heat generator corresponds to a width of a sheet with a minimum width among the sheets of various sizes fed to the image forming apparatus 1.

Meanwhile, as the heating source 25, not only the above-described halogen heater but also a heating source of an electromagnetic induction heating (IH) system or the like can also be utilized, and furthermore, there is another option in which a heating source can be provided by constituting the heating roller 24 or the fixing belt 21 with a resistive heating element.

The auxiliary pad 26 is formed of a long plate-like member extending along the width direction of the fixing belt 21, and is fixed onto an outer surface of the standing wall 23*c* provided in the sandwiching member 23 such that a large part of the auxiliary pad is arranged in the space on the inner side of the fixing belt 21. The auxiliary pad 26 functions as a guide to guide the fixing belt 21 and also is used to apply lubricant to the inner peripheral surface of the fixing belt 21.

More specifically, the auxiliary pad 26 is provided at a position more on the downstream side in the rotational direction of the fixing belt 21 than the later-described nip N is, and includes a lubricant feeder 26*a* as an applier. The lubricant feeder 26*a* is formed of, for example, a felt impregnated with lubricant, and when the inner peripheral surface of the fixing belt 21 abuts on the lubricant feeder 26*a*, the lubricant is fed to the inner peripheral surface of the fixing belt 21. Consequently, slidability between the fixing belt 21 and the pressure pad 22 is improved.

The first chassis 31 that rotatably supports the pressure roller 10 and the second chassis 32 that supports the pressure pad 22 via the sandwiching member 23 are connected by the pair of biasing members 33 formed of coil springs or the like. With this structure, in a state in which the first chassis 31 and the second chassis 32 are biased in a direction to come close to each other by biasing force of the pair of biasing members 33, the fixing belt 21 is pressed against the pressure pad 22 by the pressure roller 10, thereby achieving a pressed state in which the pressure pad 22 is pressed by the pressure roller 10.

The fixing belt 21 is stretched around the above-described pressure pad 22, heating roller 24, and auxiliary pad 26. With this structure, the fixing belt 21 can be rotated in a manner sliding on the first main surface 22*a* of the pressure pad 22, and with this rotation, an area of the fixing belt 21 contacting the heating roller 24 is heated by the heating source 25, and then, when this area of the fixing belt 21 is moved to the nip N described later, a toner image formed on a sheet S fed to the nip N is heated by this area of the fixing belt 21.

As illustrated in FIG. 3, in the fixing device 8A according to the present embodiment, when the pressure roller 10 is rotationally driven in a direction of an arrow A indicated in FIG. 3 by the above-described drive source (not illustrated) in a state in which the pressure roller 10 is biased toward the fixing belt unit 20 side by the pair of biasing members 33 as described above, the fixing belt 21 is rotationally driven in a direction of an arrow B indicated in FIG. 3 in a manner sliding on the pressure pad 22.

Consequently, the nip N through which a sheet S is conveyed is formed between the pressure roller 10 and the pressure pad 22 (more strictly, between the pressure roller 10 and the outer peripheral surface of the fixing belt 21). In other words, the pressure roller 10 and the fixing belt unit 20 are arranged in a manner sandwiching the conveyance path 4 such that the nip N formed therebetween is located on the sheet conveyance path 4.

Here, in a case where the elastic layer 12 is exposed without providing the above-described release layer at both ends of the pressure roller 10 excluding an area corresponding to the above-described sheet passing region R1, frictional resistance with the fixing belt 21 (here, both ends are areas corresponding to a pair of outer regions R2 included in the nip N and located on both outer sides of the sheet passing region R1 (refer to FIG. 4)) can be increased at both ends, and the fixing belt 21 can be rotationally driven with higher efficiency.

Also, in addition to this or instead of this, in a case where the elastic layer is exposed without providing the above-described release layer at both ends excluding the area included in the fixing belt 21 and corresponding to the above-described sheet passing region R1 (here, both ends are areas corresponding to the pair of the outer regions R2 included in the nip N and located on both outer sides of the sheet passing region R1 (refer to FIG. 4)), frictional resistance with the pressure roller 10 can be increased at both ends, and the fixing belt 21 can be rotationally driven with higher efficiency.

Note that an aligned direction of the pressure roller 10 and the fixing belt unit 20 in the pressed state in which the pressure pad 22 is pressed by the pressure roller 10 corresponds to a pressing direction DR1 of the pressure roller 10, and a direction that is orthogonal to the pressing direction DR1 and orthogonal to the axial direction of the pressure roller 10 (i.e., width direction of the fixing belt 21) corresponds to the conveyance direction DR2 of a sheet S.

An entrance-side guide 41 is provided at a position that is located on the conveyance path 4 and also located at a more upstream position in the conveyance direction DR2 of a sheet S than the nip N is (i.e., lower-side position in FIG. 3). The entrance-side guide 41 is a guide to surely allow a sheet S conveyed along the conveyance path 4 to enter the nip N.

A separation guide 42 and an exit-side guide 43 are provided at positions that are located on the conveyance path 4 and also located at more downstream positions in the conveyance direction DR2 of a sheet S than the nip N is (i.e., upper-side position in FIG. 3). The separation guide 42 is a guide to separate, from the fixing belt 21, a sheet S that adheres to the fixing belt 21 when the sheet S is ejected from the nip N, and the exit-side guide 43 is a guide to surely put back, onto the conveyance path 4, the sheet S separated from the fixing belt 21 by the separation guide 42.

With the above structure, in the fixing device 8A according to the present embodiment, heat and pressure are applied to a toner image formed on a sheet S during fixing operation (namely, in the above-describe pressed state) at the nip N, thereby fixing the toner image onto the sheet S.

Here, as described above, in the case where the pressure pad is simply formed of the long plate-like member and the abutting part of the sandwiching member is formed in a flat plate shape, not only the pressure pad but also the abutting part of the sandwiching member that reinforces the pressure pad are deflected because pressing force of the pressure roller is extremely high during fixing operation. Therefore, without any countermeasure, distribution of pressure applied to a sheet at the nip is largely varied along the width direction of the fixing belt due to the deflection, and this may cause fixing unevenness, and quality of a formed image may be largely degraded.

More specifically, without any countermeasure, the pressure is decreased at a width-direction center of the nip, and the pressure is increased at width-direction both ends of the nip, and as a result, a fixing state of a toner image becomes insufficient at the width-direction center of the nip, and quality of a formed image becomes uneven.

Therefore, in the fixing device 8A according to the present embodiment, such a problem is solved by providing a characteristic shape of the second main surface 22*b* of the pressure pad 22 without increasing the thickness of the sandwiching member 23 that reinforces the pressure pad 22. This point will be described in detail below.

Figure 5A:
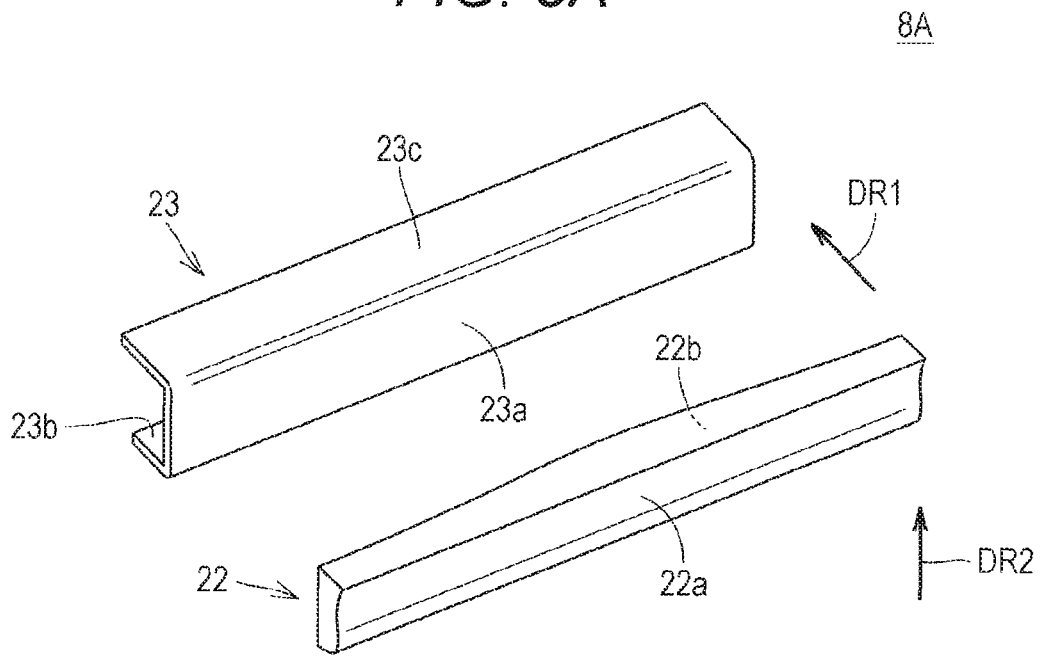
FIGS. 5A and 5B are schematic views illustrating a shape of each of a pressure pad and a sandwiching member of the fixing device illustrated in FIG. 2.
Figure 5B:
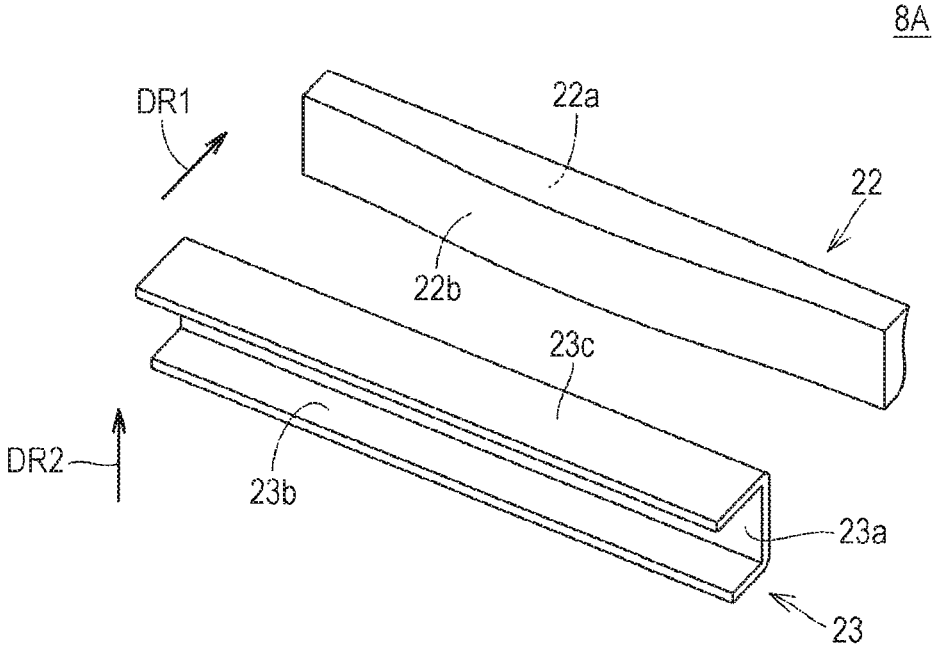
Figure 6A:
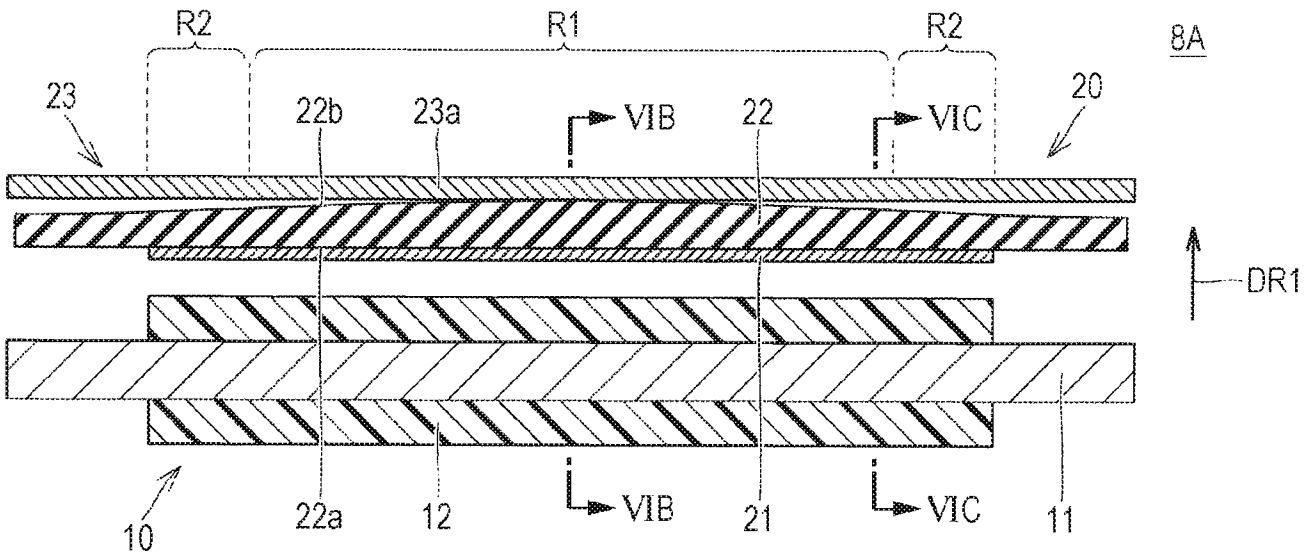
FIGS. 6A to 6C are schematic cross-sectional views illustrating a state of the fixing device illustrated in FIG. 2 during a standby period.
Figure 6B:
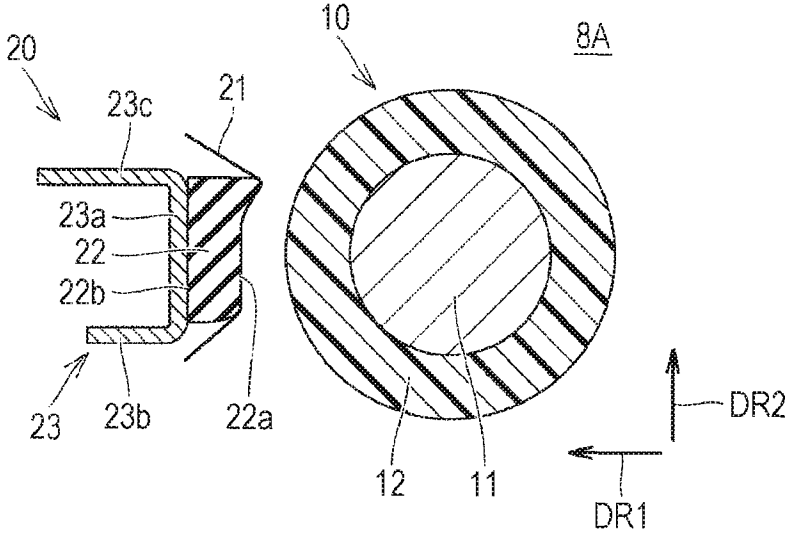
Figure 6C:
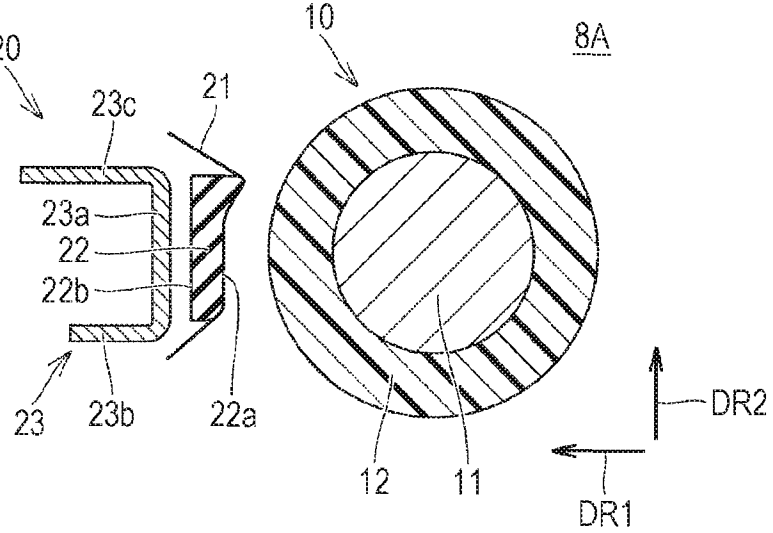
Figure 7A:
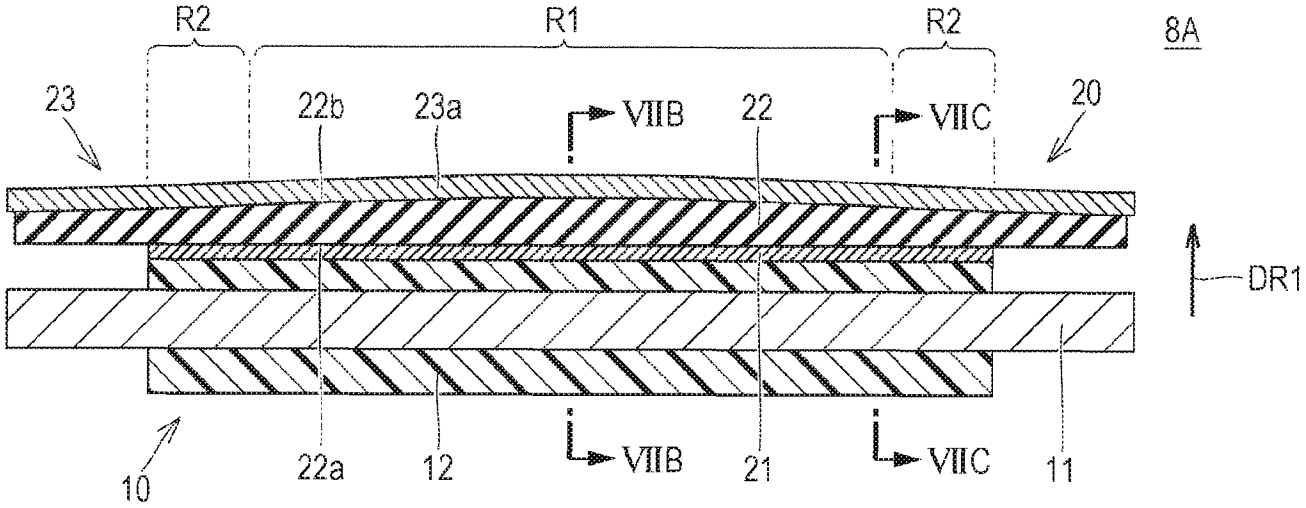
FIGS. 7A to 7C are schematic cross-sectional views illustrating a state of the fixing device illustrated in FIG. 2 during fixing operation.
Figure 7B:
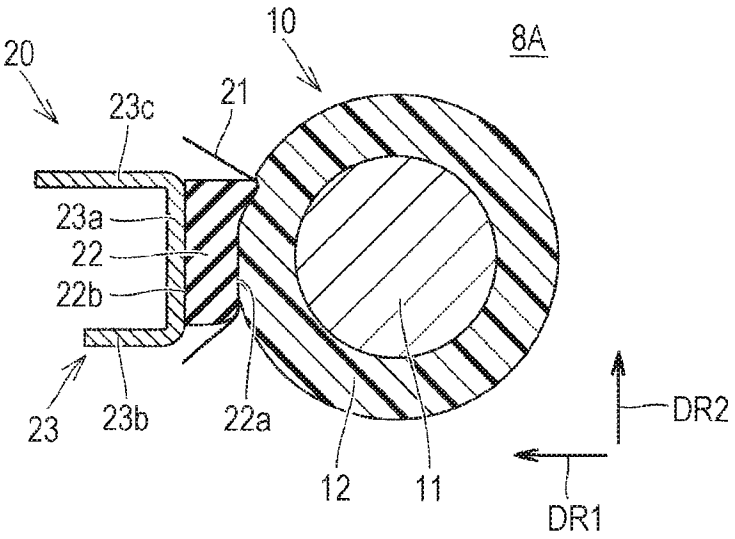
Figure 7C:
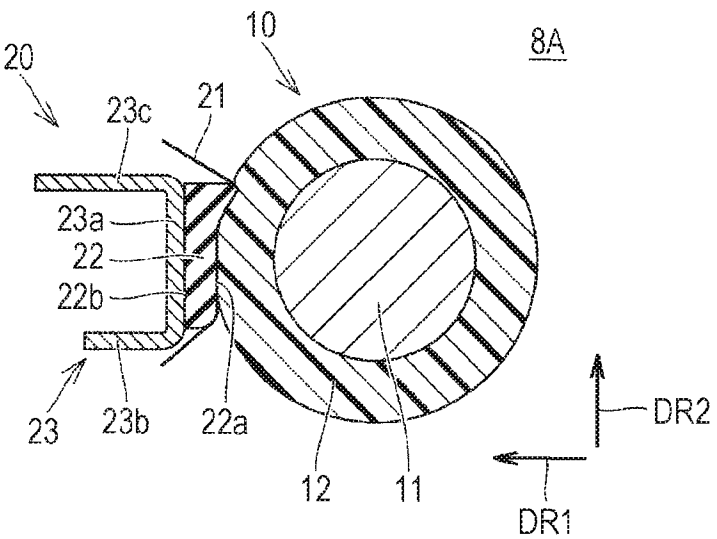

FIGS. 5A and 5B are schematic views illustrating a shape of each of the pressure pad and the sandwiching member of the fixing device illustrated in FIG. 2. Additionally, FIGS. 6A to 6C are schematic cross-sectional views illustrating a state of the fixing device illustrated in FIG. 2 during a standby period, and FIGS. 7A to 7C are schematic cross-sectional views illustrating a state thereof during fixing operation.

Here, FIG. 5A is the view of the pressure pad 22 and the sandwiching member 23 when respectively viewed from the pressure roller 10 side, and FIG. 5B is the view of the pressure pad 22 and the sandwiching member 23 when respectively viewed from the heating roller 24 side. Additionally, FIGS. 6A and 7A illustrate cross sections each traversing a center of the nip N in the above-described conveyance direction DR2 of a sheet S, and FIGS. 6B and 7B illustrate cross sections taken along a line VIB-VIB illustrated in FIG. 6A and a line VIIB-VIIB illustrated in FIG. 7A respectively, and FIGS. 6C and 7C illustrate cross sections taken along a line VIC-VIC illustrated in FIG. 6A and a line taken along a line VIIC-VIIC illustrated in FIG. 7A respectively.

As illustrated in FIGS. 5A, 5B, and 6A to 6C, in the fixing device 8A according to the present embodiment, a surface included in the abutting part 23*a* of the sandwiching member 23 and facing the second main surface 22*b* of the pressure pad 22 is formed flat, whereas the second main surface 22*b* of the pressure pad 22 has a predetermined curved shape.

Specifically, in a state in which the pressure pad 22 is not pressed by the pressure roller 10 (i.e., standby state), a width-direction center of an area included in the second main surface 22*b* and corresponding to the sheet passing region R1 provided in the nip N has a shape bulging more toward the abutting part 23*a* side of the sandwiching member 23 than width-direction both ends of the area included in the second main surface 22*b* and corresponding to the sheet passing region R1 provided in the nip N.

More specifically, a bulging amount of in the area included in the second main surface 22*b* of the pressure pad 22 and corresponding to the sheet passing region R1 provided in the nip N is gradually increased like a mountain shape from the width-direction both ends toward the width-direction center of the area, thereby having a so-called positive crown shape. Here, a surface shape in the width direction of the second main surface 22*b* of the pressure pad 22 is the same at every position in the conveyance direction DR2 of a sheet S.

Since the pressure pad 22 is held loosely by the sandwiching member 23 as described above, in the standby state, the pressure pad 22 and the sandwiching member 23 are not in a press-contacting state. Therefore, as illustrated in FIGS. 6A and 6C, at least the width-direction both ends of the area included in the second main surface 22*b* and corresponding to the sheet passing region R1 provided in the nip N do not abut on the abutting part 23*a* of the sandwiching member 23.

On the other hand, as illustrated in FIGS. 7A to 7C, during the fixing operation in that the state becomes the pressed state in which the pressure pad 22 is pressed by the pressure roller 10, the pressure roller 10 presses the fixing belt 21 against the pressure pad 22 and also the pressure pad 22 is pressed against the sandwiching member 23 by the pressure pad 22 being pressed by the pressure roller 10 via the fixing belt 21. Consequently, the sandwiching member 23 may be deflected to a considerable extent.

Here, displacement caused by the deflection of the sandwiching member 23 can be absorbed by the bulging part provided on the second main surface 22*b* side of the pressure pad 22 by appropriately setting a bulging amount of the above-described second main surface 22*b* of the pressure pad 22. Accordingly, as a result, deflection of the pressure pad 22 can be suppressed while an entire region of an area included in the second main surface 22*b* and corresponding to the sheet passing region R1 provided in the nip N is made to closely contact the abutting part 23*a*. Consequently, it is possible to substantially uniformly apply pressure to a sheet S along the axial direction of the pressure roller 10 (i.e., width direction of the fixing belt 21) in the sheet passing region R1 of the nip N.

Therefore, it is possible to prevent pressure shortage at a width-direction center of the nip N, and a toner image can be uniformly fixed in an entire region in the width direction of the nip N, and quality of a formed image can be greatly improved.

Here, in a case of adopting the above-described structure, pressure can be uniformly applied in the width direction of the nip N only by providing the predetermined curved shape to the second main surface 22*b* of the pressure pad 22 while forming the abutting part 23*a* of the sandwiching member 23 in the flat plate shape, and therefore, the abutting part 23*a* of the sandwiching member 23 can be formed sufficiently thin, and heat capacity of the sandwiching member 23 can be reduced. Therefore, increase in the heat capacity of the fixing device 8A as a whole can also be suppressed, and a goal of energy saving can be sufficiently achieved.

Furthermore, in the case of adopting the above-described structure, it is possible to obtain a secondary effect of easily achieving complex pressure distribution to be applied to a sheet S at the nip N. This point will be described in detail below.

Generally, to obtain a high-quality image, it may be important to appropriately control pressure distribution along the sheet conveyance direction at the nip N in addition to uniforming the pressure in the width direction of the nip in the area corresponding to the above-described sheet passing region. Here, it is desirable that the pressure distribution along the sheet conveyance direction at the nip be relatively low at the entrance-side area of the nip and the pressure be relatively high at the exit-side area of the nip.

Figure 8:
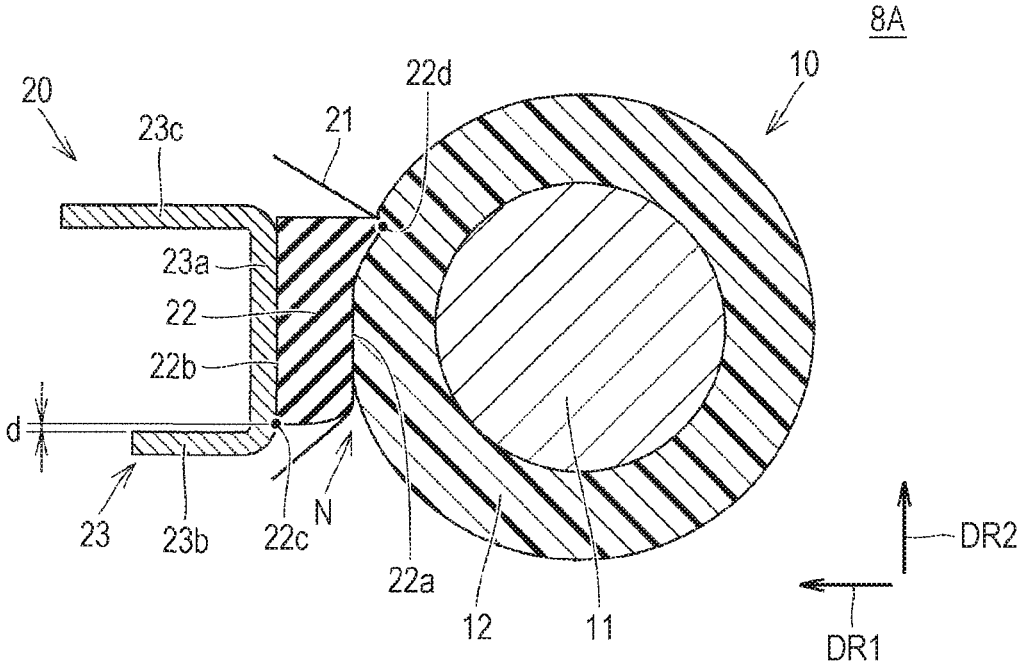
FIG. 8 is a schematic cross-sectional view illustrating a state of a main part of the fixing device illustrated in FIG. 2 during fixing operation.

The reason is that a high-quality image can be obtained by sufficiently melting toner adhering to a sheet surface and then pressing the melted toner against a sheet with higher pressure at the time of fixing of a toner image. In a case where pressure is increased at the entrance-side area of the nip, a part of the melted toner is strongly pressed against the sheet before all of the toner is melted sufficiently, and this may cause fixing unevenness In this respect, in the fixing device 8A according to the present embodiment, such a problem is solved by providing the characteristic shape of the first main surface 22*a* of the pressure pad 22. FIG. 8 is a schematic cross-sectional view illustrating the state of a main part of the fixing device illustrated in FIG. 2 during fixing operation.

Specifically, in the fixing device 8A according to the present embodiment, a protruding amount of the first main surface 22*a* of the pressure pad 22 toward the pressure roller 10 side is substantially constant in an area located on the downstream side in the conveyance direction DR2 of a sheet S (the area corresponding to the entrance-side area of the nip N), and as a position advances to an area located on the downstream side in the conveyance direction DR2 of a sheet S (the area corresponding to the exit-side area of the nip N) from an area in the vicinity of a center in the conveyance direction DR2 of a sheet S (the area corresponding to the vicinity of an intermediate area between the entrance-side area and the exit-side area of the nip N), the protruding amount is substantially gradually increased.

In other words, an end 22*d* located in a downstream side in the conveyance direction DR2 of a sheet S and included in the area which is included in the first main surface 22*a* of the pressure pad 22 and corresponds to the sheet passing region R1 of the nip N protrudes toward the pressure roller 10 side.

Therefore, with adoption of this structure, pressure distribution along the conveyance direction DR2 of a sheet S at the nip N can be optimized as described above, and therefore, a high-quality image can be obtained. Furthermore, in the case of adopting the above structure, the melted toner can be surely pressed against the sheet S at the exit-side area of the nip N, and therefore, separability of the sheet S from the fixing belt 21 can be improved after sheet passage at the nip N.

As described above, in the fixing device 8A according to the present embodiment, complex pressure distribution to be applied to the sheet S at the nip N is achieved by the shape at the first main surface 22*a* and the shape of the second main surface 22*b* of the pressure pad 22 which are respectively different from each other. More specifically, pressure distribution along the conveyance direction DR2 of the sheet S at the nip N can be appropriately controlled by forming the shape of the first main surface 22*a* of the pressure pad 22 as described above, and as a result, fixing performance and separability can be improved, whereas pressure in the width direction at the area corresponding to the sheet passing region R1 of the nip N can be made uniform by forming the shape of the second main surface 22*b* of the pressure pad 22 as described above, and as a result, fixing unevenness is suppressed.

In other words, the fixing device 8A according to the present embodiment can easily achieve complex pressure distribution to be applied to a sheet S at the nip N by making the first main surface 22*a* and the second main surface 22*b* of the pressure pad 22 have different functions, and consequently, design, manufacture, and quality control of the fixing device can be more easily performed than in the related art.

Here, as illustrated in FIG. 8, in the fixing device 8A according to the present embodiment, in the pressed state in which the pressure pad 22 is pressed by the pressure roller 10, the second main surface 22*b* of the pressure pad 22 further abuts on the abutting part 23*a* of the sandwiching member 23 at a position more on the downstream side in the conveyance direction DR2 of a sheet S than at a position corresponding to the standing wall 23*b* of the sandwiching member 23 provided at the position on the upstream side in the conveyance direction DR2 of a sheet S.

In other words, an end 22*c* located on the upstream side in the conveyance direction DR2 of a sheet S and included in the area which is included in the second main surface 22*b* of the pressure pad 22 and corresponds to the sheet passing region R1 of the nip N is arranged at a position retracted from the standing wall 23*b* of the sandwiching member 23 by a distance d along the conveyance direction DR2 of a sheet S.

Here, since the standing wall 23*b* functions as a reinforcing rib in the area included in the abutting part 23*a* of the sandwiching member 23 and provided with the standing wall 23*b*, the area is suppressed from deflection more than an area provided with no standing wall 23*b*. Therefore, in a case where the pressure pad 22 is made to abut on the area included in the abutting part 23*a* and provided with the standing wall 23*b*, pressure more than required may be applied to a sheet S at the nip N at a position corresponding to this area.

Therefore, with the above-described structure, it is possible to prevent increase in the pressure applied to a sheet S at the entrance-side area of the nip N, and as a result, toner adhering to the surface of the sheet S can be sufficiently melted at the entrance-side area of the nip N. Therefore, with the above-described structure, it is further possible to appropriately control pressure distribution along the conveyance direction DR2 of the sheet S at the nip N.

Note that the fixing device 8A according to the present embodiment has the structure, as described above, in which the sandwiching member 23 is fixed to the second chassis 32 by having both ends of the sandwiching member 23 being supported by the second chassis 32. Here, it is preferable that the sandwiching member 23 be supported by the second chassis 32 at both ends located on a more outer side in the width direction than the area corresponding to the sheet passing region R1 of the nip N.

The reason is that: in the case where the area included in the sandwiching member 23 and corresponding to the sheet passing region R1 of the nip N is fixed, deflection caused at the sandwiching member 23 becomes more complex in the pressed state where the pressure pad 22 is pressed by the pressure roller 10, and in this case, it becomes necessary to set a bulging shape at the second main surface 22*b* of the pressure pad 22 in accordance with such complex deflection of the sandwiching member 23.

In other words, as described above, the bulging shape of the second main surface 22*b* of the pressure pad 22 can be more easily determined by forming the structure in which the sandwiching member 23 is supported by the second chassis 32 at both ends located on the more outer side in the width direction than the area corresponding to the sheet passing region R1 of the nip N.

First Modified Example

Figure 9:
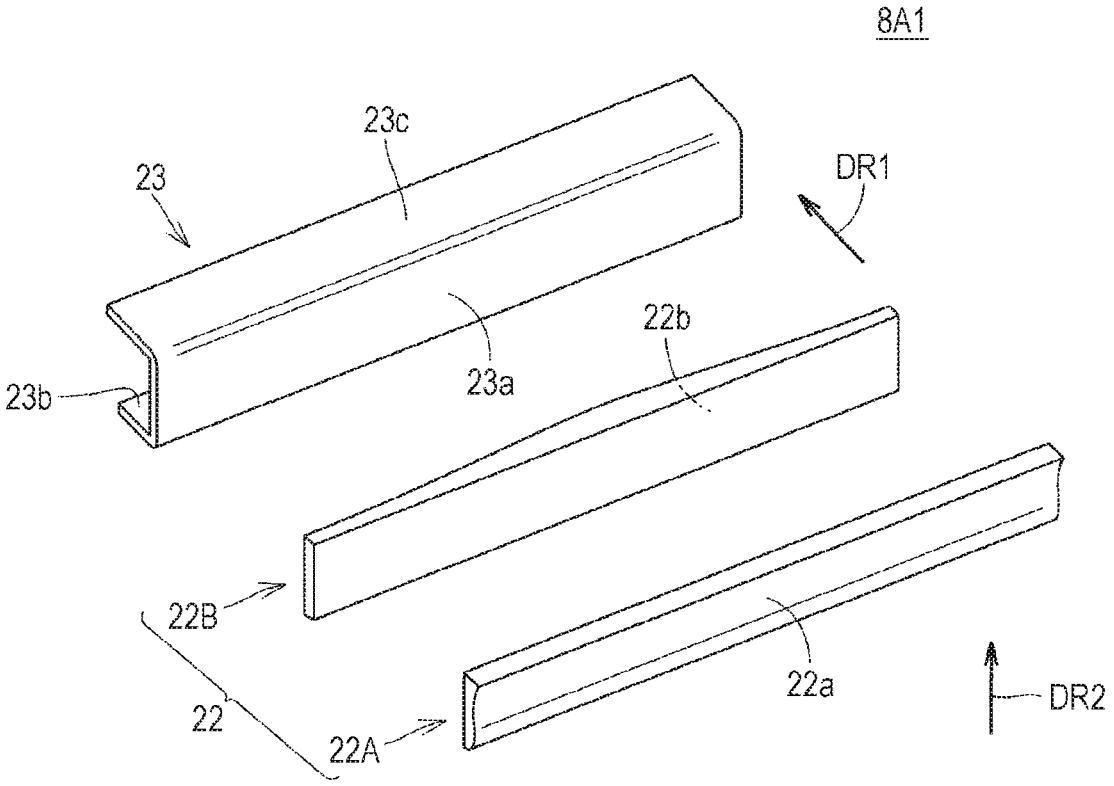
FIG. 9 is a schematic view illustrating a shape of each of a pressure pad and a sandwiching member of a fixing device according to a first modified example.

FIG. 9 is a schematic diagram illustrating a shape of each of a pressure pad and a sandwiching member of a fixing device according to a first modified example. In the following, a fixing device 8A1 according to the present modified example will be described with reference to FIG. 9. Note that FIG. 9 is a view of the pressure pad 22 and the sandwiching member 23 when respectively viewed from the pressure roller 10 side.

As illustrated in FIG. 9, in a fixing device 8A1 according to the present modified example, the pressure pad 22 is formed of a composite component combining two components. Specifically, the pressure pad 22 includes: a first member 22A that is arranged on the pressure roller 10 side and defines the above-described first main surface 22*a*; and a second member 22B that is arranged on the sandwiching member 23 side and defines the above-described second main surface 22*b*, and the pressure pad is formed by arranging the second member 22B out of these members in a manner aligned with the first member 22A in the pressing direction DR1 of the pressure roller 10 and further fixing the second member 22B to the first member 22A in a closely contacting manner.

In a case of adopting this structure, multiple kinds of first members 22A having shapes of first main surfaces 22*a* different from each other and multiple kinds of second members 22B having shapes of second main surfaces 22*b* different from each other are prepared in advance so as to make the respective first main surfaces 22*a* and second main surfaces 22*b* of the pressure pad 22 have different functions, thereby enabling combination of optimal members out of these first and second members, and therefore, design, manufacture, and quality control can be more easily performed in a case of manufacturing, for example, fixing devices having multiple kinds of different specifications, in a case of changing the design, and the like.

Second Modified Example

Figure 10:
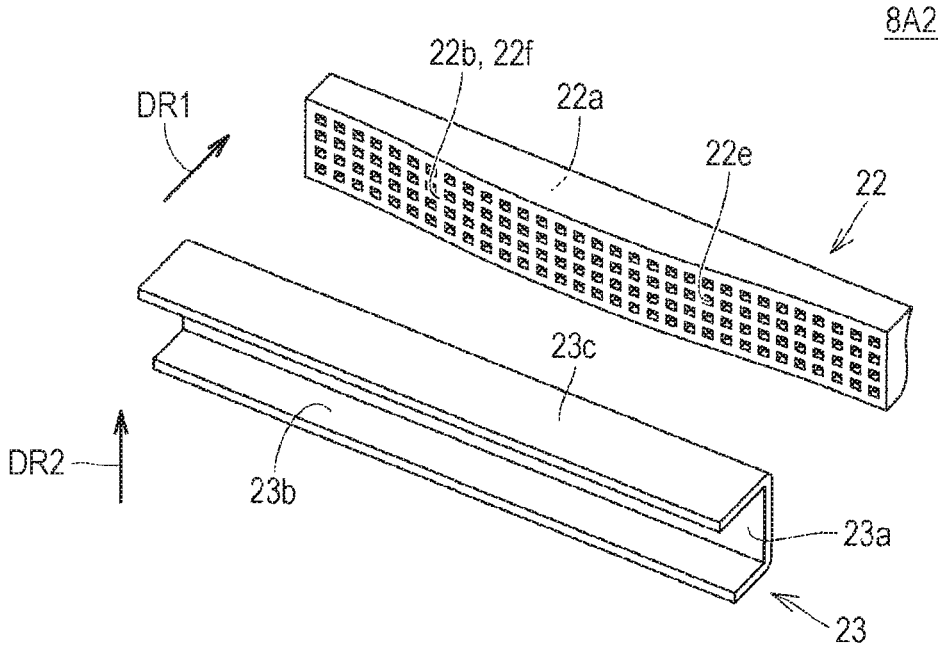
FIG. 10 is a schematic view illustrating a shape of each of a pressure pad and a sandwiching member of a fixing device according to a second modified example.

FIG. 10 is a schematic diagram illustrating a shape of each of a pressure pad and a sandwiching member of a fixing device according to a second modified example. In the following, a fixing device 8A2 according to the present modified example will be described with reference to FIG. 10. Note that FIG. 10 is a view of the pressure pad 22 and the sandwiching member 23 when viewed from the heating roller 24 side.

As illustrated in FIG. 10, in the fixing device 8A2 according to the present modified example, a plurality of recesses 22*e* is provided on the second main surface 22*b* of the pressure pad 22. Each of the plurality of recesses 22*e* is surrounded by protrusions 22*f* in an entire periphery thereof in a direction orthogonal to the pressing direction DR1 of the pressure roller 10, and in the present modified example, the protrusions 22*f* are formed in a lattice shape. Therefore, in the pressed state in which the pressure pad 22 is pressed by the pressure roller 10, a top surface of each of the protrusions 22*f* in the lattice shape closely contacts the abutting part 23*a* of the sandwiching member 23.

With this structure, pressure can be applied to the sheet S almost as planned without unevenness in the entire region of the nip N, and heat capacity of the pressure pad 22 can be reduced. Therefore, it is possible to suppress occurrence of unevenness in an image formed on a sheet S while saving energy. Here, at least the above-described plurality of recesses 22*e* is provided substantially uniform in the area included in the second main surface 22*b* and corresponding to the sheet passing region R1 from the viewpoint of applying pressure to a sheet S almost as planned in the entire region of the sheet passing region R1 provided in the nip N.

Third Modified Example

Figure 11:
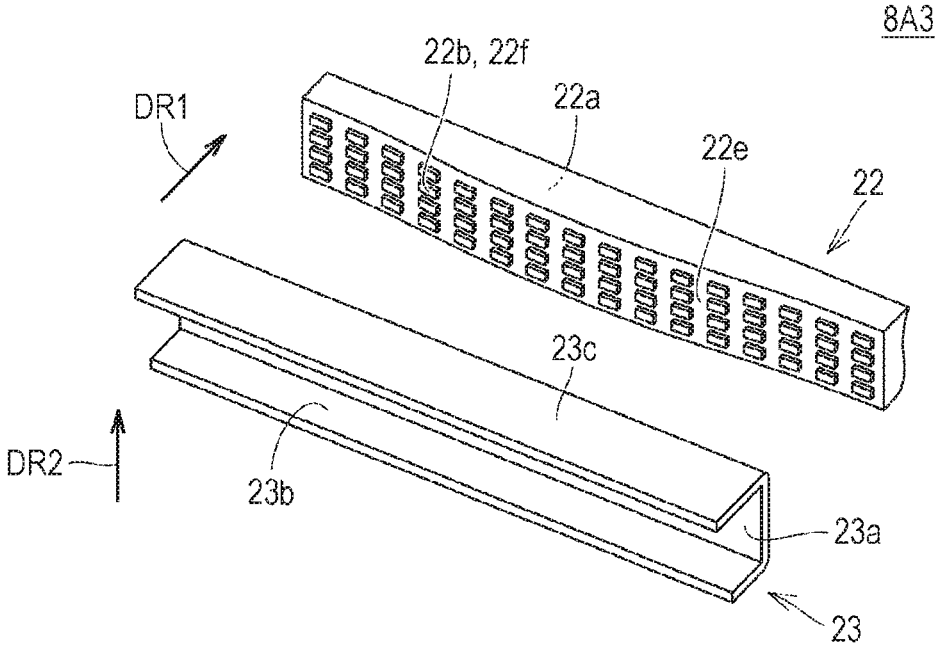
FIG. 11 is a schematic view illustrating a shape of each of a pressure pad and a sandwiching member of a fixing device according to a third modified example.

FIG. 11 is a schematic diagram illustrating a shape of each of a pressure pad and a sandwiching member of a fixing device according to a third modified example. In the following, a fixing device 8A3 according to the present modified example will be described with reference to FIG. 11. Note that FIG. 11 is a view of the pressure pad 22 and the sandwiching member 23 when viewed from the heating roller 24 side.

As illustrated in FIG. 11, in the fixing device 8A3 according to the present modified example, a plurality of elongated protrusions 22*f* is provided on the second main surface 22*b* of the pressure pad 22. Each of the plurality of elongated protrusions 22*f* has both sides sandwiched by the recesses 22*e* in a direction orthogonal to the pressing direction DR1 of the pressure roller 10, and in the present modified example, the recesses 22*e* are formed in a lattice shape. Therefore, in the pressed state in which the pressure pad 22 is pressed by the pressure roller 10, a top surface of each of the plurality of elongated protrusion 22*f* closely contacts the abutting part 23*a* of the sandwiching member 23.

With this structure, pressure can be applied to the sheet S almost as planned without unevenness in the entire region of the nip N, and heat capacity of the pressure pad 22 can be reduced. Therefore, it is possible to suppress occurrence of unevenness in an image formed on a sheet S while saving energy. Here, at least the above-described plurality of elongated protrusions 22*f* is provided substantially uniform on the area included in the second main surface 22*b* and corresponding to the sheet passing region R1 from the viewpoint of applying pressure to a sheet S without unevenness almost as planned in the entire region of the sheet passing region R1 provided in the nip N.

Fourth Modified Example

Figure 12:
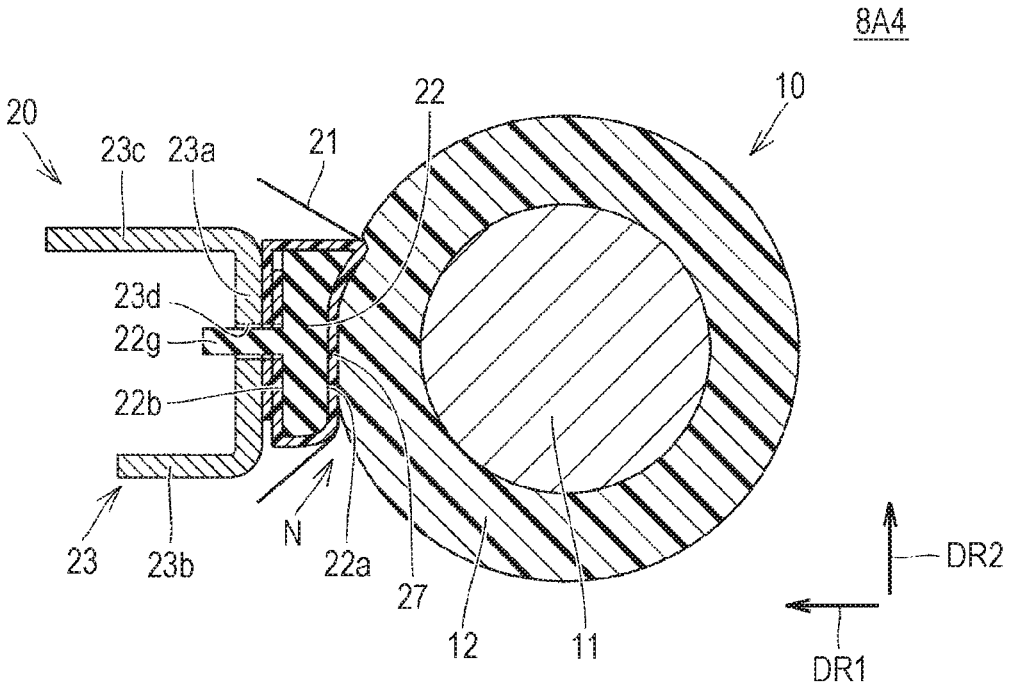
FIG. 12 is a schematic cross-sectional view of a main part of a fixing device according to a fourth modified example.
Figure 13:
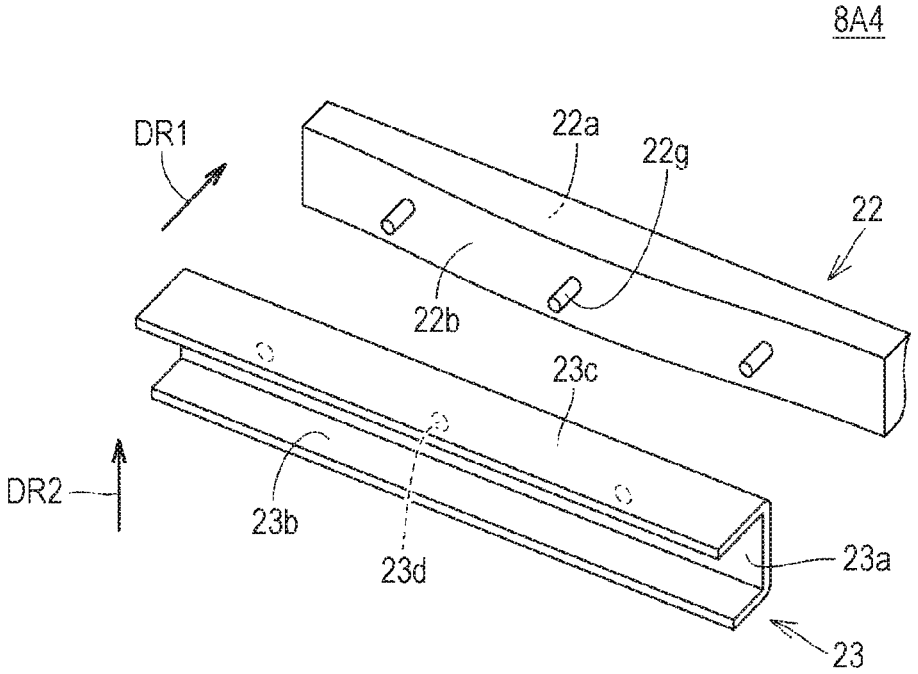
FIG. 13 is a schematic view illustrating a shape of each of a pressure pad and a sandwiching member of the fixing device illustrated in FIG. 12.

FIG. 12 is a schematic cross-sectional view of a main part of a fixing device according to a fourth modified example, and FIG. 13 is a schematic diagram illustrating a shape of each of a pressure pad and a sandwiching member of the fixing device illustrated in FIG. 12. In the following, a fixing device 8A4 according to the present modified example will be described with reference to FIGS. 12 and 13. Note that FIG. 13 is a view of each of the pressure pad 22 and the sandwiching member 23 when viewed from the heating roller 24 side.

As illustrated in FIG. 12, the fixing device 8A4 according to the present modified example includes a low friction member 27 that covers the first main surface 22*a* and the second main surface 22*b* of the pressure pad 22. The low friction member 27 is a member to keep good slidability of the fixing belt 21 on the first main surface 22*a* of the pressure pad 22, and is formed of, for example, a sliding sheet having a surface with low frictional resistance.

As the above-described sliding sheet, for example, a sheet having a surface covered with a coating layer of a fluorine series resin or the like is generally used, but besides that, a woven fabric of fluorine fibers or a sheet of a fluorine series resin, or the like can also be utilized. Additionally, the sliding sheet may also be integrally formed with the pressure pad 22 by covering the surface of the pressure pad 22 with a coating layer of glass, a fluorine series resin, or the like without forming the low friction member 27 separately from the pressure pad 22.

Here, in the fixing device 8A4 according to the present modified example, the low friction member 27 is formed of the sliding sheet, and the sliding sheet is attached to the pressure pad 22 by being wound around the pressure pad 22 to surround the pressure pad 22 while setting a direction parallel to the width direction of the fixing belt 21 as an axis.

More specifically, as illustrated in FIGS. 12 and 13, in the fixing device 8A4 according to the present modified example, a hole is provided in an area of the sliding sheet covering the second main surface 22*b*, and the pressure pad 22 is provided with an engagement pin 22*g* that is inserted through this hole of the sliding sheet by the engagement pin protruding from the second main surface 22*b* toward the sandwiching member 23, and the sliding sheet is attached to the pressure pad 22 by using the pin and hole. Furthermore, the engagement pin 22*g* provided at the pressure pad 22 is inserted through a hole 23*d* provided in the abutting part 23*a* of the sandwiching member 23, and the pressure pad 22 around which the sliding sheet is wound is held loosely by the sandwiching member 23.

With this structure, energy can be saved and unevenness in an image can be suppressed while improving slidability of the fixing belt 21.

Second Embodiment

Figure 15A:
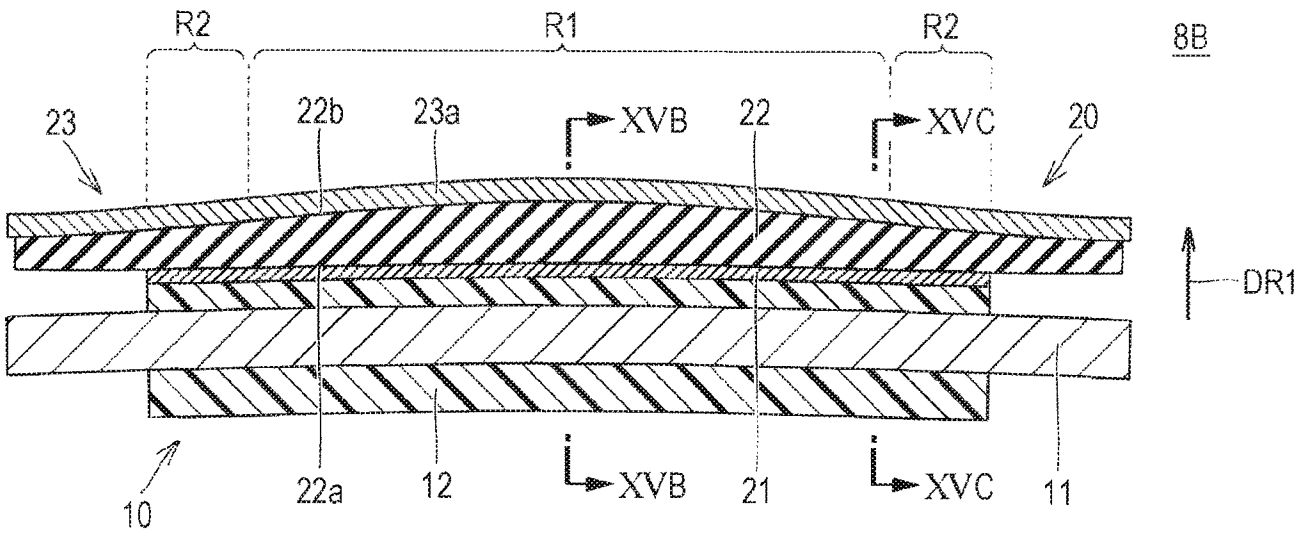
FIGS. 15A to 15C are schematic cross-sectional views illustrating a state of the fixing device according to the second embodiment during fixing operation.
Figure 15B:
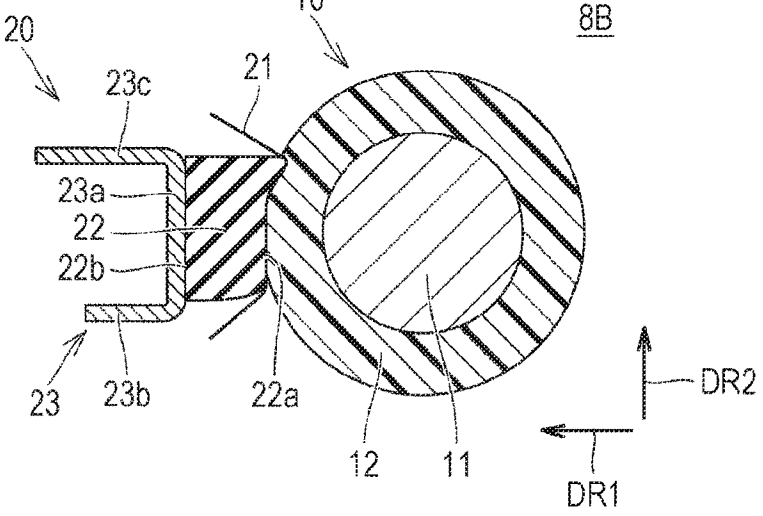
Figure 15C:
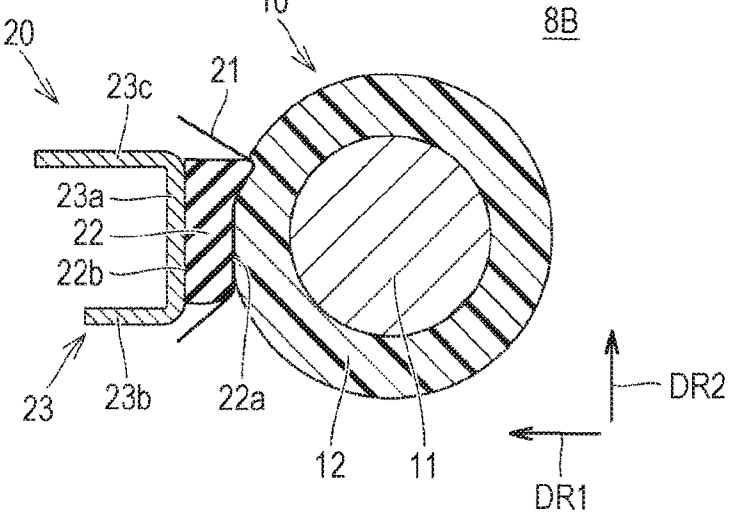

FIGS. 14A to 14C are schematic cross-sectional views illustrating a state of a fixing device according to a second embodiment during a standby period, and FIGS. 15A to 15C are schematic cross-sectional views illustrating a state thereof during fixing operation. In the following, a structure and operation of a fixing device 8B according to the present embodiment will be described with reference to FIGS. 14A to 14C and 15A to 15C. Note that the fixing device 8B according to the present embodiment is incorporated in an image forming apparatus 1 according to a first embodiment described above instead of a fixing device 8A according to the above-described first embodiment.

Here, FIGS. 14A and 15A illustrate cross sections each traversing a center of a nip N in a conveyance direction DR2 of a sheet S described above, and FIGS. 14B and 15B illustrate cross sections taken along a line XIVB-XIVB illustrated in FIG. 14A and a line XVB-XVB illustrated in FIG. 15A respectively, and FIGS. 14C and 15C illustrate cross sections taken along a line XIVC-XIVC illustrated in FIG. 14A and a line XVC-XVC illustrated in FIG. 15A respectively.

In the fixing device 8B according to the present embodiment, a first main surface 22*a* and a second main surface 22*b* of a pressure pad 22 are made to have different functions in a manner similar to the above-described fixing device 8A according to the first embodiment, thereby relatively easily achieving complex pressure distribution to be applied to a sheet S at the nip N, but the function exerted by the second main surface 22*b* differs from that in the case of the fixing device 8A according to the above-described first embodiment.

Generally, in the fixing device, not only the pressure pad and a sandwiching member that reinforces the pressure pad are deflected but also a pressure roller is deformed, that is so-called bending, when the pressing force in a pressed state in which the pressure pad is pressed by a pressure roller is increased. In the case where such bending occurs, the pressing force applied to the fixing belt is more decreased at the center than at axial both ends of the pressure roller, and as a result, fixing of a toner image at a width-direction center of the nip N becomes insufficient, and unevenness occurs in quality of a formed image.

Accordingly, in the fixing device 8B according to the present embodiment, the second main surface 22*b* of the pressure pad 22 is structured so as to prevent occurrence of the above-described problems in advance, considering not only pressure nonuniformity in the width direction of the fixing belt 21 caused by the above-described deflection possibly occurring at the sandwiching member 23 but also pressure nonuniformity in the width direction of the fixing belt 21 caused by the above-described bending at the pressure roller 10.

Specifically, as illustrated in FIGS. 14A to 14C, in the fixing device 8B according to the present embodiment, a surface of an abutting part 23*a* of the sandwiching member 23 facing the second main surface 22*b* of the pressure pad 22 is formed flat, whereas the second main surface 22*b* of the pressure pad 22 has a predetermined curved shape.

More specifically, similar to the case of the above-described first embodiment, in a state in which the pressure pad 22 is not pressed by the pressure roller 10 (i.e., standby state), a width-direction center of an area included in the second main surface 22*b* and corresponding to a sheet passing region R1 provided in the nip N has a shape bulging toward the abutting part 23*a* side of the sandwiching member 23 more than width-direction both ends of the area included in the second main surface 22*b* and corresponding to the sheet passing region R1 provided in the nip N. Note that the second main surface 22*b* of the pressure pad 22 has a positive crown shape described above.

Here, in the present embodiment, a bulging amount of the second main surface 22*b* of the pressure pad 22 is larger than that in the case of the above-described first embodiment, and with this structure, not only displacement caused by deflection of the sandwiching member 23 but also displacement of the pressure roller 10 caused by bending can be absorbed by the bulging part provided on the second main surface 22*b* side of the pressure pad 22.

Therefore, as illustrated in FIGS. 15A to 15C, bending as illustrated in the drawings occurs at the pressure roller 10 (refer to particularly FIG. 15A) during fixing operation in that a state becomes a pressed state in which the pressure pad 22 is pressed by the pressure roller 10, however; displacement caused by the deflection of the sandwiching member 23 and displacement caused by bending of the pressure roller 10 can be absorbed by the bulging part provided on the second main surface 22*b* of the pressure pad 22 by appropriately setting the bulging amount of the second main surface 22*b* side of the pressure pad 22. Therefore, as a result, a press-contacting state between the pressure pad 22 and the pressure roller 10 via the fixing belt 21 can be made uniform in the axial direction of the pressure roller 10 while an entire region of the area included in the second main surface 22*b* and corresponding to the sheet passing region R1 provided in the nip N is made to closely contact the abutting part 23*a*. Consequently, it is possible to substantially uniformly apply pressure to a sheet S along the axial direction of the pressure roller 10 (i.e., width direction of the fixing belt 21) in the sheet passing region R1 of the nip N.

Therefore, with this structure, even in a case where bending occurs in the pressure roller 10 in the pressed state in which the pressure pad 22 is pressed by the pressure roller 10, shortage of pressure at the width-direction center of the nip N can be prevented in advance, a toner image can be uniformly fixed in an entire region in the width direction of the nip N, and quality of a formed image can be greatly improved.

Third Embodiment

Figure 16A:
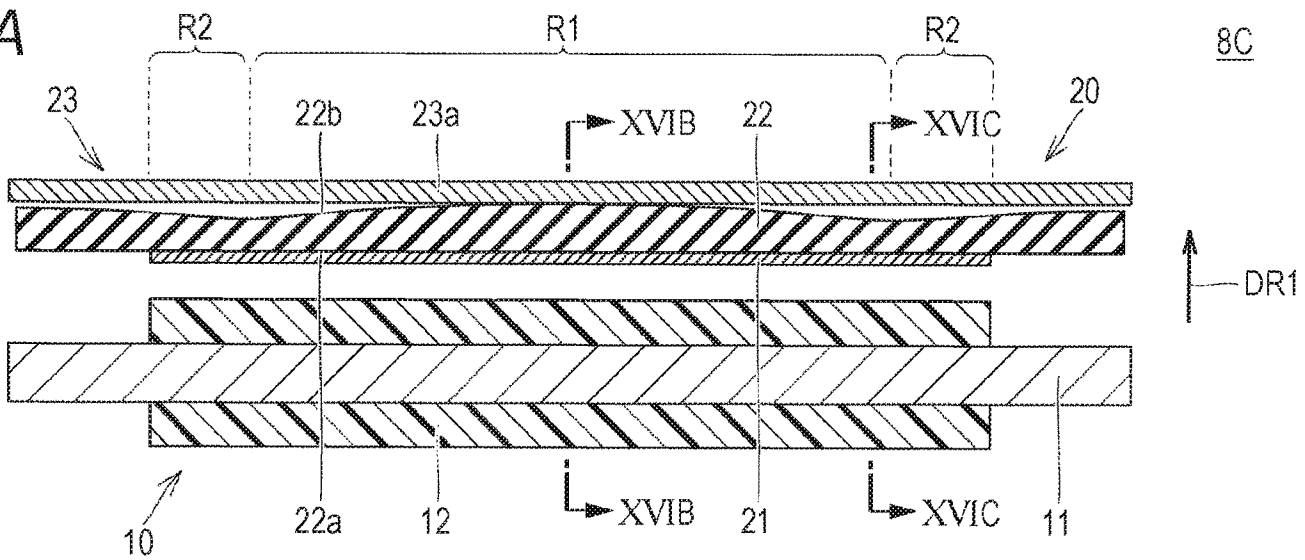
FIGS. 16A to 16C are schematic cross-sectional views illustrating a state of the fixing device according to a third embodiment during a standby period.
Figure 16B:
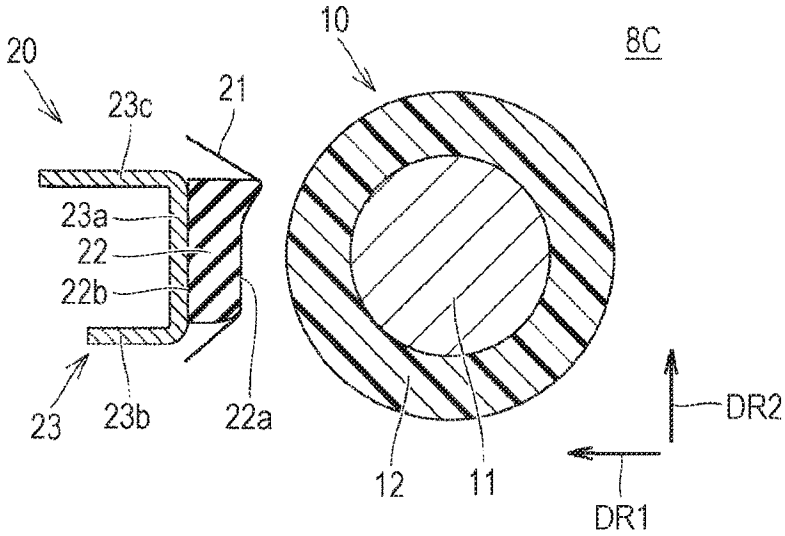
Figure 16C:
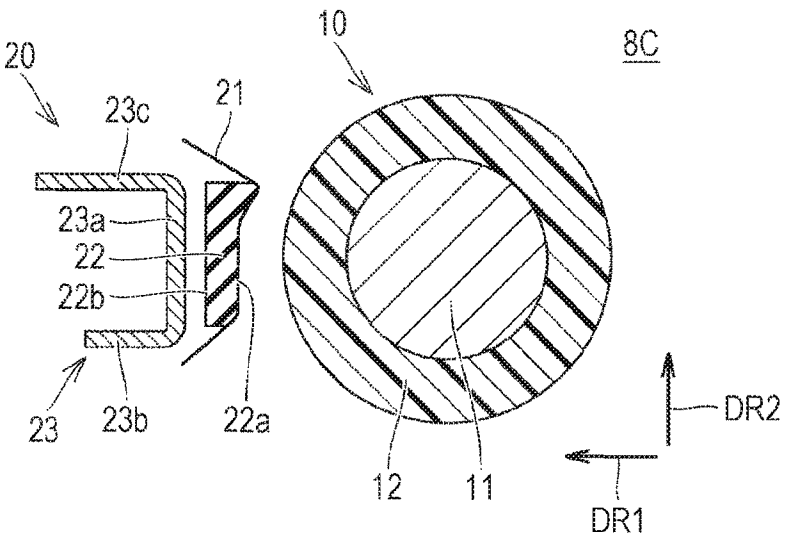
Figure 17A:
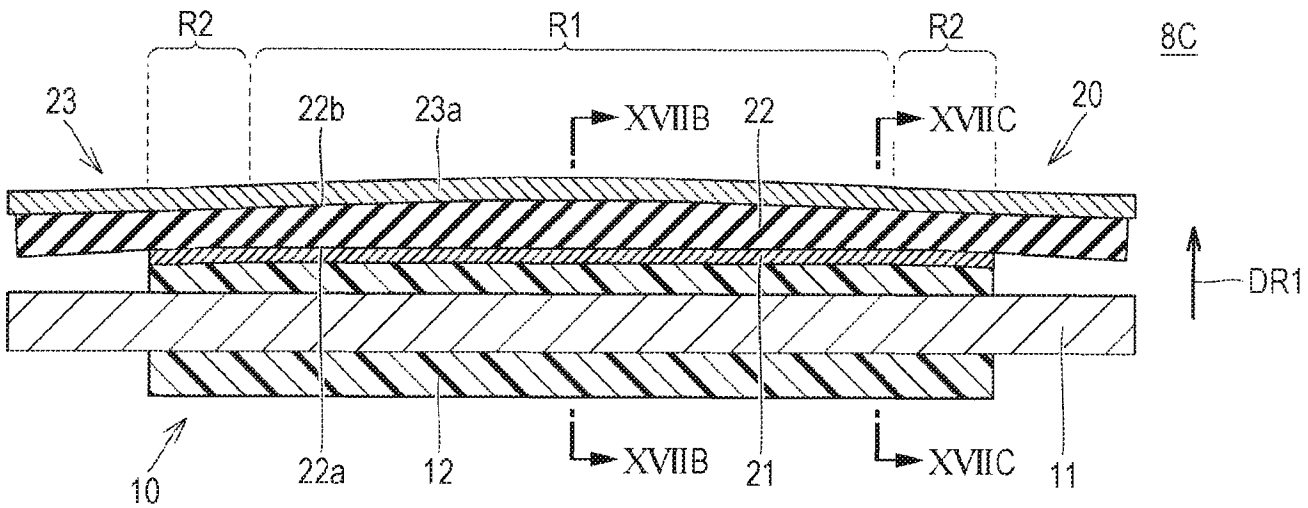
FIGS. 17A to 17C are schematic cross-sectional views illustrating a state of the fixing device according to the third embodiment during fixing operation.
Figure 17B:
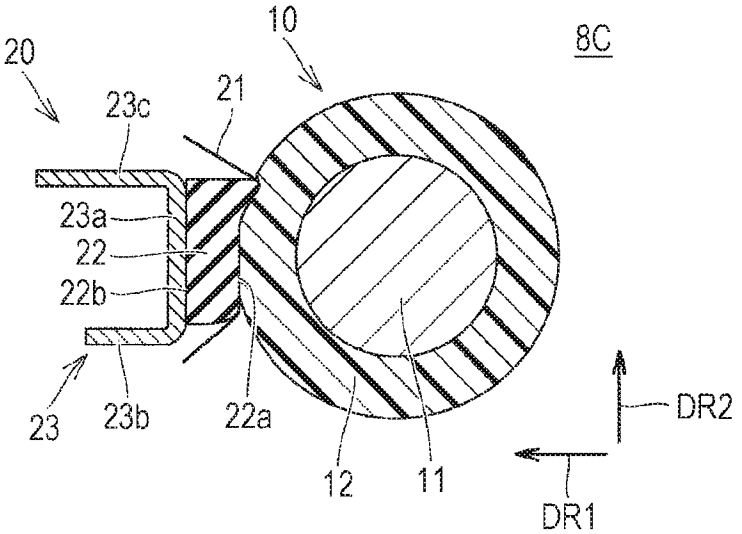
Figure 17C:
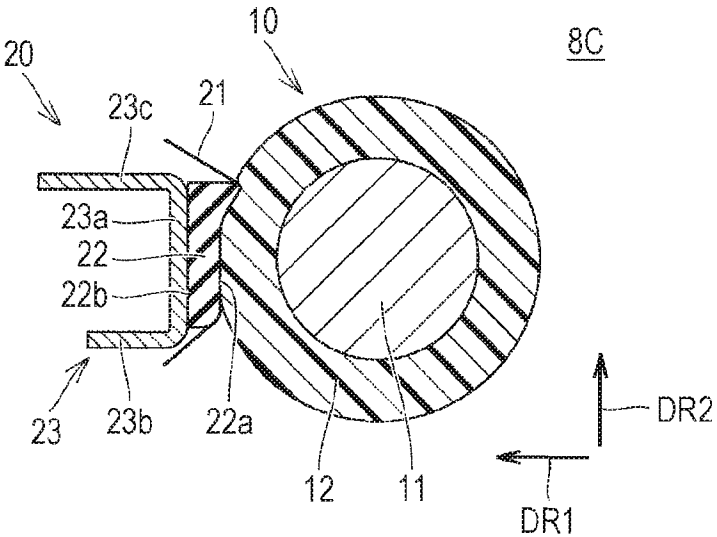

FIGS. 16A to 16C are schematic cross-sectional views illustrating a state of a fixing device according to a third embodiment during a standby period, and FIGS. 17A to 17C are schematic cross-sectional views illustrating a state thereof during fixing operation. In the following, a structure and operation of a fixing device 8C according to the present embodiment will be described with reference to FIGS. 16A to 16C and 17A to 17C. Note that the fixing device 8C according to the present embodiment is incorporated in an image forming apparatus 1 according to a first embodiment described above instead of a fixing device 8A according to the above-described first embodiment.

Here, FIGS. 16A and 17A illustrate cross sections each traversing a center of the nip N in a conveyance direction DR2 of a sheet S described above, and FIGS. 16B and 17B illustrate cross sections taken along a line XVIB-XVIB illustrated in FIG. 16A and a line XVIIB-XVIIB illustrated in FIG. 17A respectively, and FIGS. 16C and 17C illustrate cross sections taken along a line XVIC-XVIC illustrated in FIG. 16A and a line taken along a line XVIIC-XVIIC illustrated in FIG. 17A respectively.

In the fixing device 8C according to the present embodiment, a first main surface 22*a* and a second main surface 22*b* of a pressure pad 22 are made to have different functions in a manner similar to the above-described fixing device 8A according to the first embodiment, thereby relatively easily achieving complex pressure distribution to be applied to a sheet S at a nip N, but the function exerted by the second main surface 22*b* differs from that in the case of the fixing device 8A according to the above-described first embodiment.

Specifically, in the fixing device 8B according to the present embodiment, the second main surface 22*b* of the pressure pad 22 is made to have a function by which a fixing belt 21 is sandwiched between a pressure roller 10 and a sandwiching member 23 with high pressure in a pair of outer regions R2 located more on an outer side than a sheet passing region R1 of the nip N in order to achieve more reliable conveyance of a sheet S.

As illustrated in FIGS. 16A to 16C, in the fixing device 8C according to the present embodiment, a surface of an abutting part 23*a* of the sandwiching member 23 facing the second main surface 22*b* of the pressure pad 22 is formed flat, whereas the second main surface 22*b* of the pressure pad 22 has a predetermined curved shape.

More specifically, similar to the case of the above-described first embodiment, in a state in which the pressure pad 22 is not pressed by the pressure roller 10 (i.e., standby state), a width-direction center of an area included in the second main surface 22*b* and corresponding to a sheet passing region R1 provided in the nip N has a shape bulging toward the abutting part 23*a* side of the sandwiching member 23 more than width-direction both ends of the area included in the second main surface 22*b* and corresponding to the sheet passing region R1 provided in the nip N.

Additionally, different from the above-described first embodiment, in the pressure pad 22, each of areas included in the second main surface 22*b* and corresponding to the pair of outer regions R2 of the nip N located more on the outer side in the width direction than the sheet passing region R1 provided in the nip N has a shape more bulging toward the abutting part 23*a* side of the sandwiching member 23 than the width-direction both ends of the area included in the second main surface 22*b* and corresponding to the sheet passing region R1 provided in the nip N.

Therefore, as illustrated in FIGS. 17A to 17C, during the fixing operation in which the state becomes the pressed state in that the pressure pad 22 is pressed by the pressure roller 10, deflection of the area of the pressure pad 22 corresponding to the sheet passing region R1 can be suppressed while an entire region of the area included in the second main surface 22*b* and corresponding to the sheet passing region R1 provided in the nip N is made to closely contact the abutting part 23*a*, and furthermore, the fixing belt 21 is sandwiched between the pressure roller 10 and the pressure pad 22 with high pressure in the areas corresponding to the pair of the outer regions R2 provided in the nip N. Consequently, slippage of the fixing belt 21 can be suppressed, and the fixing belt 21 can be more reliably rotationally driven, and as a result, reliable conveyance of a sheet S can be achieved.

Therefore, with this structure, a toner image can be uniformly fixed in the entire region in the width direction of the nip N, not only quality of a formed image quality can be greatly improved but also occurrence of conveyance failure of a sheet S can be suppressed, and occurrence of malfunctions such as jamming of a sheet S, a wrinkling of a sheet S, or fixing unevenness caused by local overheating of a sheet S can be prevented in advance.

Fourth Embodiment

Figure 18:
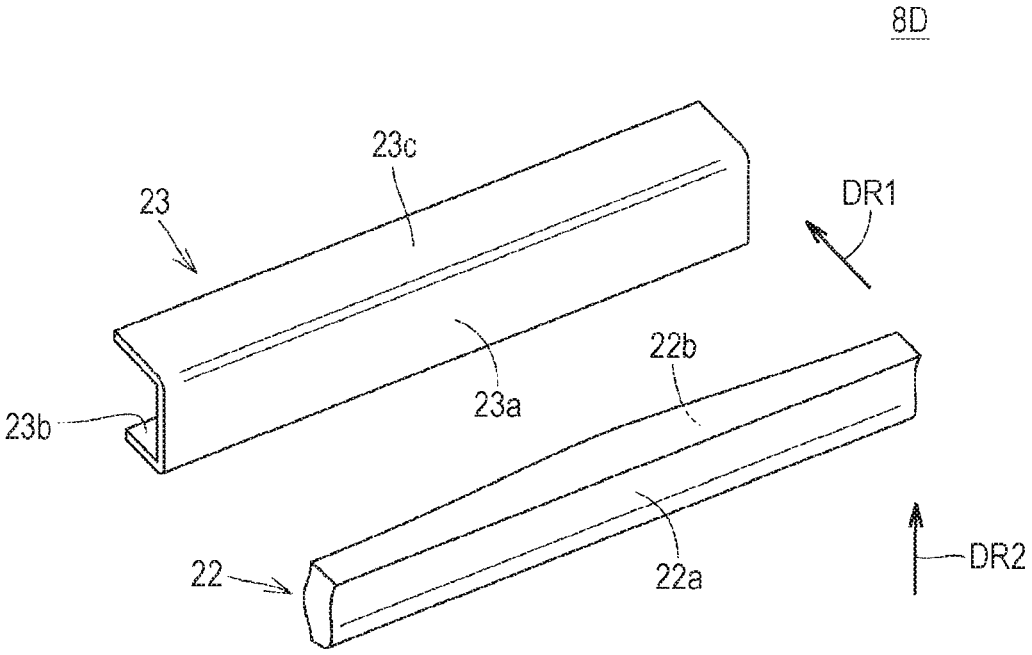
FIG. 18 is a schematic view illustrating a shape of each of a pressure pad and a sandwiching member of a fixing device according to a fourth embodiment.
Figure 19A:
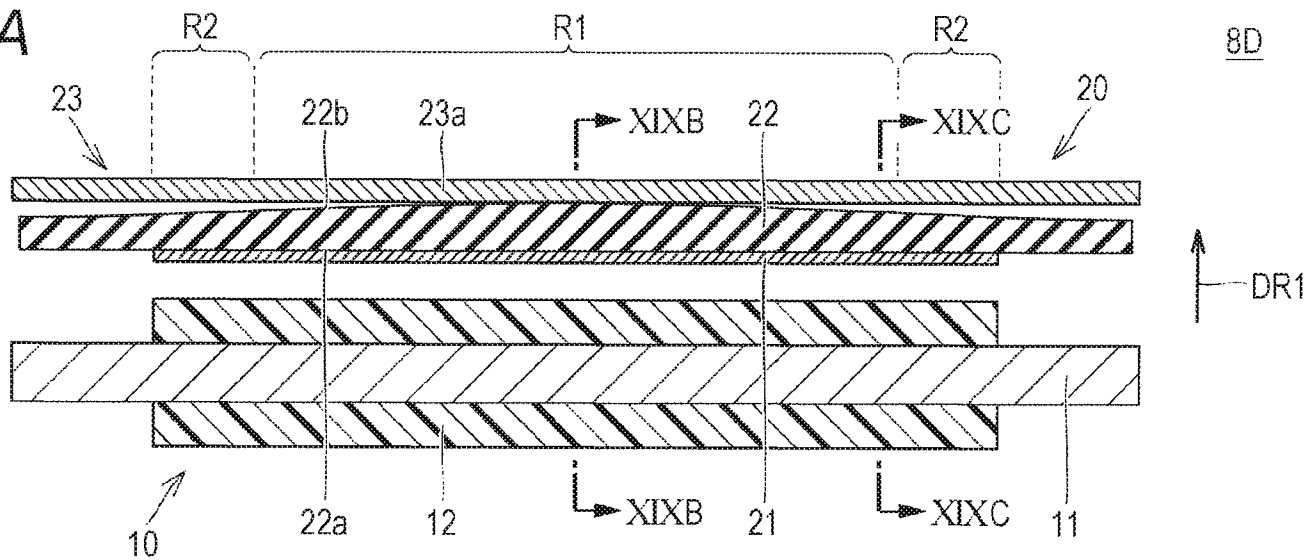
FIGS. 19A to 19C are schematic cross-sectional views illustrating a state of the fixing device according to the fourth embodiment during a standby period.
Figure 19B:
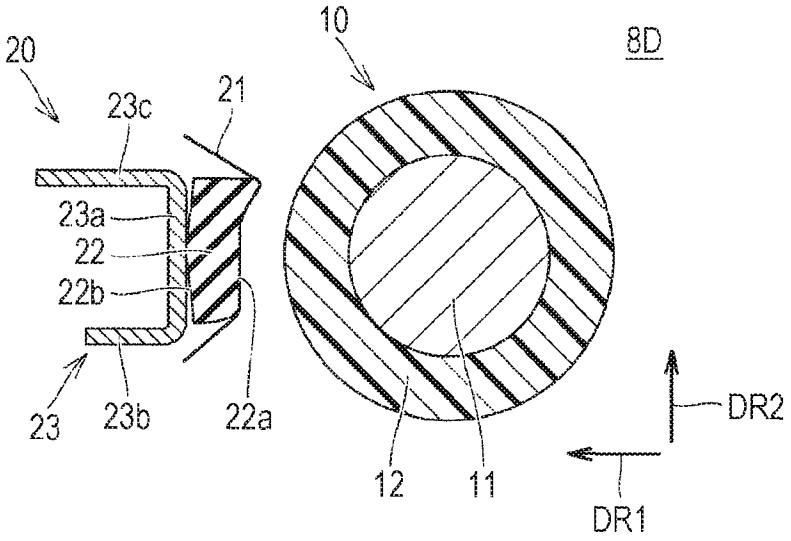
Figure 19C:
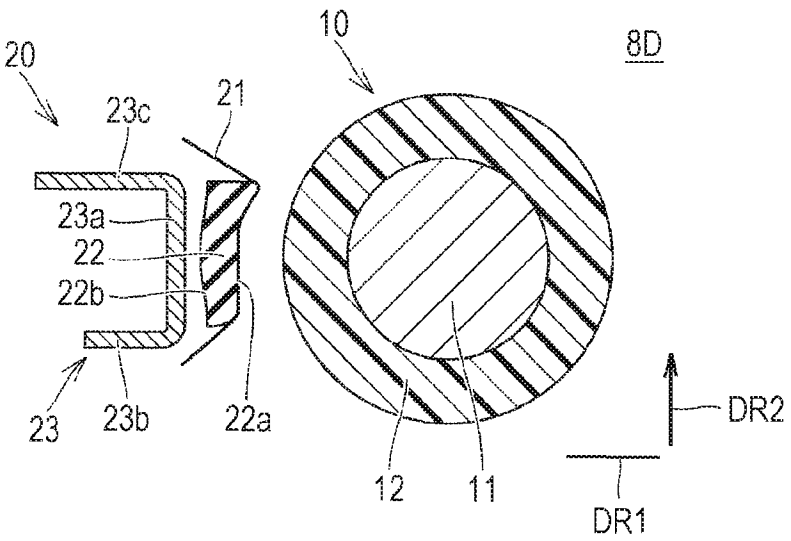
Figure 20A:
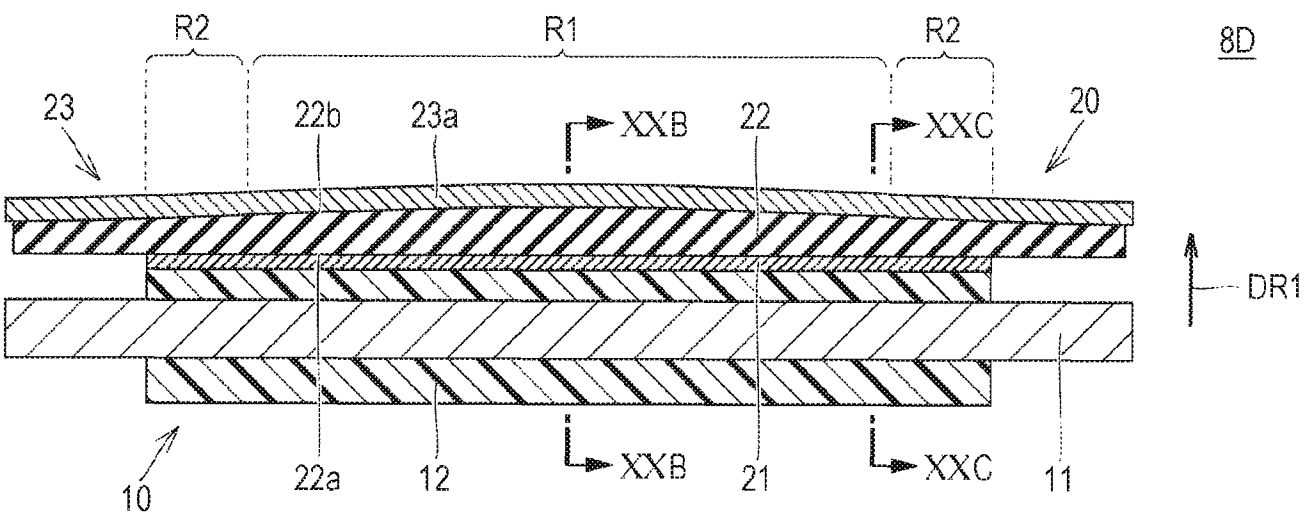
FIGS. 20A to 20C are schematic cross-sectional views illustrating a state of the fixing device according to the fourth embodiment during fixing operation.
Figure 20B:
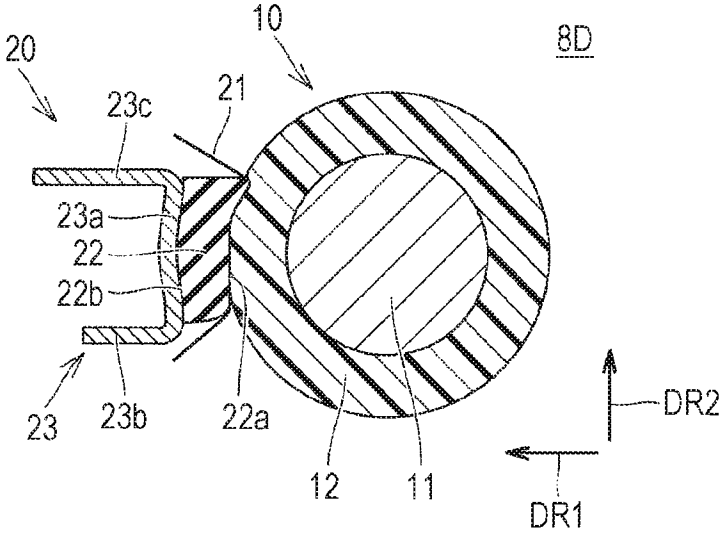
Figure 20C:
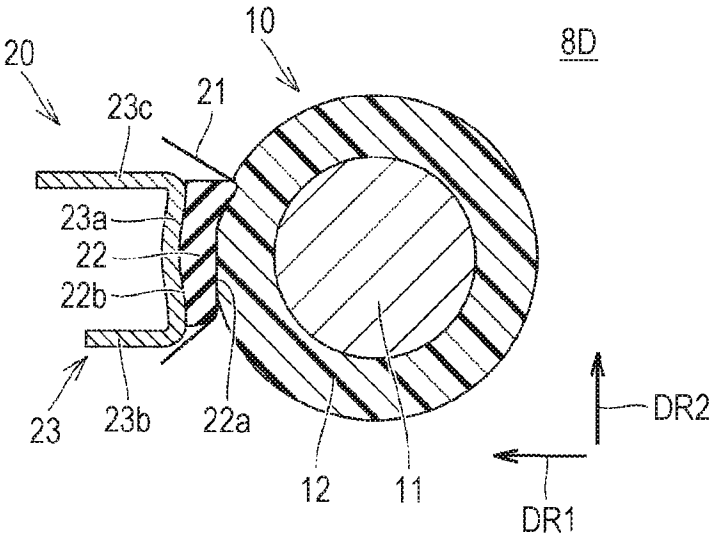

FIG. 18 is a schematic view illustrating a shape of each of a pressure pad and a sandwiching member of a fixing device according to a fourth embodiment. Additionally, FIGS. 19A to 19C are schematic cross-sectional views illustrating a state of the fixing device according to the fourth embodiment during a standby period, and FIGS. 20A to 20C are schematic cross-sectional views illustrating a state thereof during fixing operation. In the following, a structure and operation of a fixing device 8D according to the present embodiment will be described with reference to FIGS. 18 and 20A to 20C. Note that the fixing device 8D according to the present embodiment is incorporated in an image forming apparatus 1 according to a first embodiment described above instead of a fixing device 8A according to the above-described first embodiment.

Here, note that FIG. 18 is a view of the pressure pad 22 and the sandwiching member 23 when respectively viewed from the pressure roller 10 side. Additionally, FIGS. 19A and 20A illustrate cross sections each traversing a center of a nip N in a conveyance direction DR2 of a sheet S described above, and FIGS. 19B and 20B illustrate cross sections taken along a line XIXB-XIXB illustrated in FIG. 19A and a line XXB-XXB illustrated in FIG. 20A respectively, and FIGS. 19C and 20C illustrate cross sections taken along a line XIXC-XIXC illustrated in FIG. 19A and a line XXC-XXC illustrated in FIG. 20A respectively.

In the fixing device 8D according to the present embodiment, a first main surface 22*a* and a second main surface 22*b* of a pressure pad 22 are made to have different functions in a manner similar to the above-described fixing device 8A according to the first embodiment, thereby relatively easily achieving complex pressure distribution to be applied to a sheet S at the nip N, but the function exerted by the second main surface 22*b* differs from that in the case of the fixing device 8A according to the above-described first embodiment.

In other words, in a pressed state in which the pressure pad is pressed by the pressure roller, there may be a case where not only a sandwiching member is deflected along a width direction but also the sandwiching member is deflected along a sheet conveyance direction. In the case where the sandwiching member is deflected along the sheet conveyance direction, pressure distribution along the sheet conveyance direction at the nip cannot be properly controlled, and fixability and separability are degraded as a result thereof.

Here, in the present embodiment, the sandwiching member 23 has a shape with a cross section of substantially C-shape including: a plate-like abutting part 23*a*; and a pair of plate-like standing walls 23*b* and 23*c* standing from the abutting part 23*a* as illustrated in FIGS. 18 and 19A to 19C. With this structure, the pair of standing walls 23*b* and 23*c* function as reinforcing ribs.

Therefore, in the pressed state in which the pressure pad 22 is pressed by a pressure roller 10, the sandwiching member 23 is defected not only along the width direction but also along the conveyance direction DR2 of a sheet S. Due to such deflection, a center in the conveyance direction DR2 of a sheet S at the abutting part 23*a* is displaced larger than both ends in the conveyance direction DR2 of the sheet S at the abutting part 23*a*.

Therefore, in the fixing device 8D according to the present embodiment, the second main surface 22*b* of the pressure pad 22 is structured so as to prevent in advance occurrence of such problems, considering not only pressure nonuniformity in a width direction of a fixing belt 21 caused by the above-described deflection along the width direction possibly occurring in the sandwiching member 23 but also degradation of fixability and separability caused by the deflection along the conveyance direction DR2 of a sheet S possibly occurring in the sandwiching member 23.

Specifically, as illustrated in FIGS. 18 and 19A to 19C, in the fixing device 8D according to the present embodiment, a surface of the abutting part 23*a* of the sandwiching member 23 facing the second main surface 22*b* of the pressure pad 22 is formed flat, whereas the second main surface 22*b* of the pressure pad 22 has a predetermined curved shape.

More specifically, similar to the case of the above-described first embodiment, in a state in which the pressure pad 22 is not pressed by the pressure roller 10 (i.e., standby state), a width-direction center of an area included in the second main surface 22*b* and corresponding to a sheet passing region R1 provided in the nip N has a shape bulging toward the abutting part 23*a* side of the sandwiching member 23 more than width-direction both ends of the area included in the second main surface 22*b* and corresponding to the sheet passing region R1 provided in the nip N. Note that the second main surface 22*b* of the pressure pad 22 has a positive crown shape described above.

Additionally, in the state in which the pressure pad 22 is not pressed by the pressure roller 10 (i.e., standby state), a center in the conveyance direction DR2 of a sheet S in the area of the second main surface 22*b* corresponding to the sheet passing region R1 provided in the nip N has a shape bulging toward the abutting part 23*a* side of the sandwiching member 23 more than both ends in the conveyance direction DR2 of a sheet S in the area included in the second main surface 22*b* and corresponding to the sheet passing region R1 provided in the nip N. In other words, different from the above-described first embodiment, the second main surface 22*b* of the pressure pad 22 is structured such that a bulging amount of the area included in the second main surface 22*b* and corresponding to the sheet passing region R1 provided in the nip N become nonuniform in the conveyance direction DR2 of a sheet S.

Here, by appropriately setting the bulging amount of the above-described second main surface 22*b* of the pressure pad 22, displacement caused by deflection of the sandwiching member 23 can be absorbed not only in the width direction but also in the conveyance direction DR2 of a sheet S by the bulging part provided on the second main surface 22*b* side of the pressure pad 22. Accordingly, as a result, deflection of the pressure pad 22 can be suppressed while an entire region of an area included in the second main surface 22*b* and corresponding to the sheet passing region R1 provided in the nip N is made to closely contact the abutting part 23*a*. Consequently, it is possible to substantially uniformly apply pressure to a sheet S along an axial direction of the pressure roller 10 (i.e., width direction of the fixing belt 21) in the sheet passing region R1 of the nip N, and furthermore, pressure distribution along the conveyance direction DR2 of a sheet S at the nip N can be appropriately controlled.

Therefore, with this structure, a toner image can be uniformly fixed in the entire region in the width direction of the nip N, the pressure distribution along the conveyance direction DR2 of a sheet S at the nip N can be appropriately controlled, fixability and separability can be improved, and quality of a formed image can be greatly improved as a result thereof.

Fifth Embodiment

Figure 21:
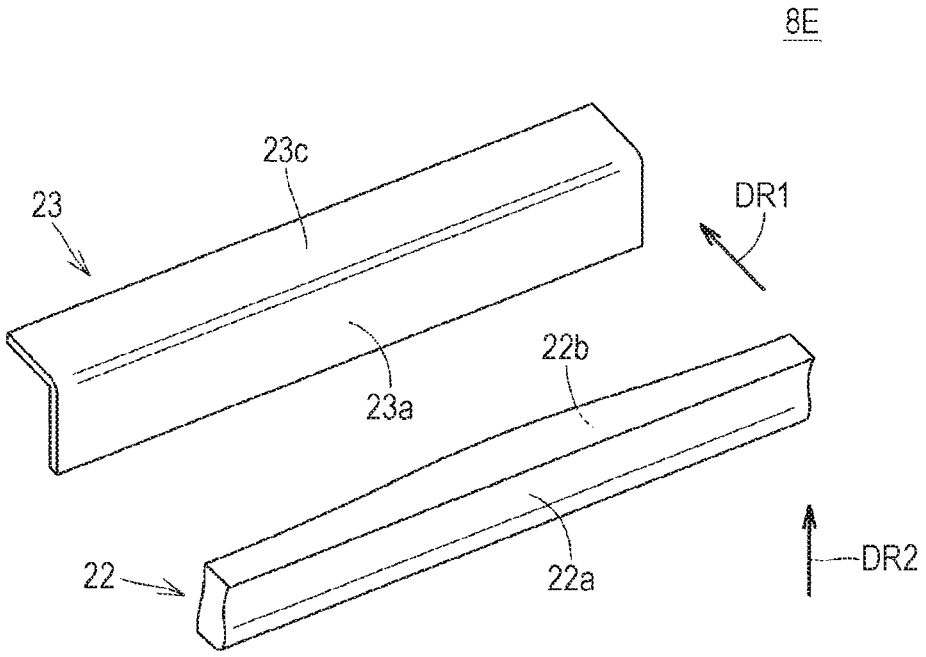
FIG. 21 is a schematic view illustrating a shape of each of a pressure pad and a sandwiching member of a fixing device according to a fifth embodiment.
Figure 22A:
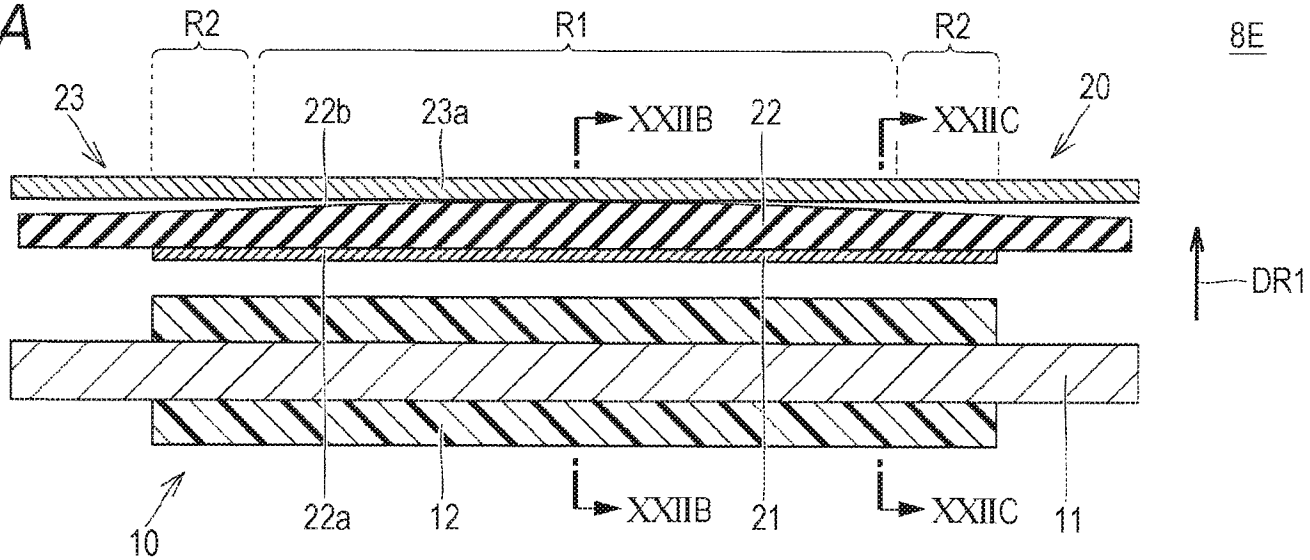
FIGS. 22A to 22C are schematic cross-sectional views illustrating a state of the fixing device according to the fifth embodiment during a standby period.
Figure 22B:
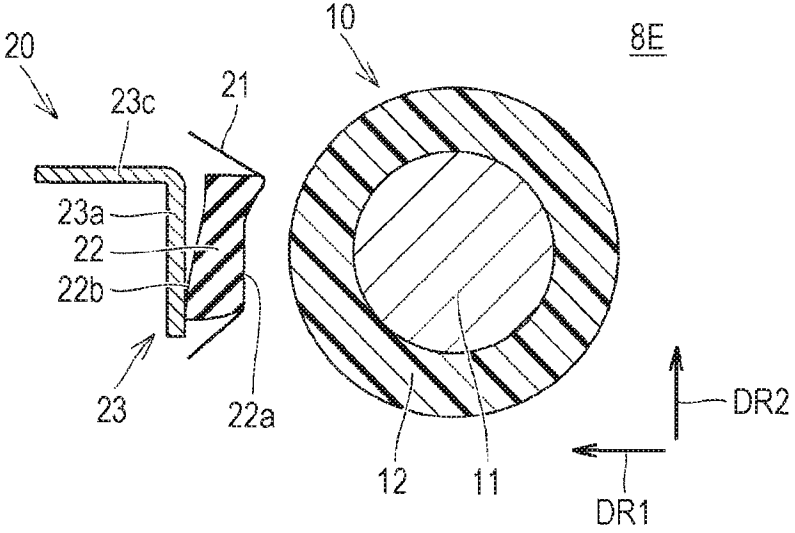
Figure 22C:
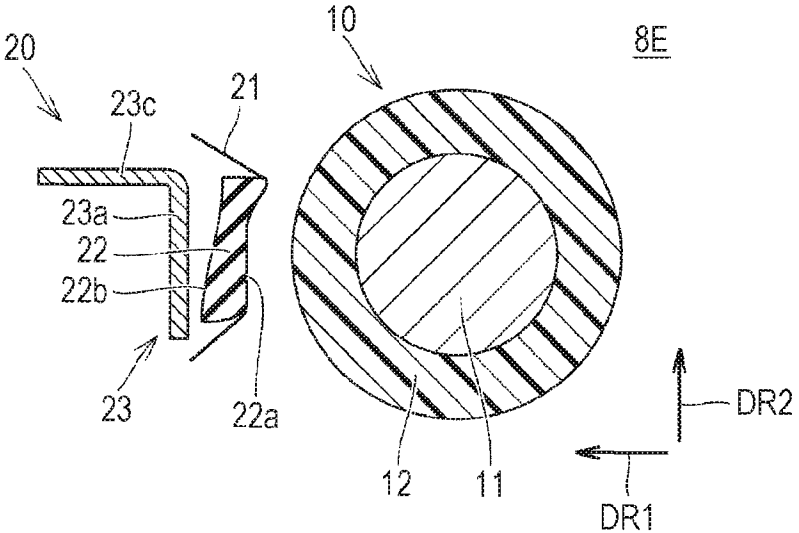
Figure 23A:
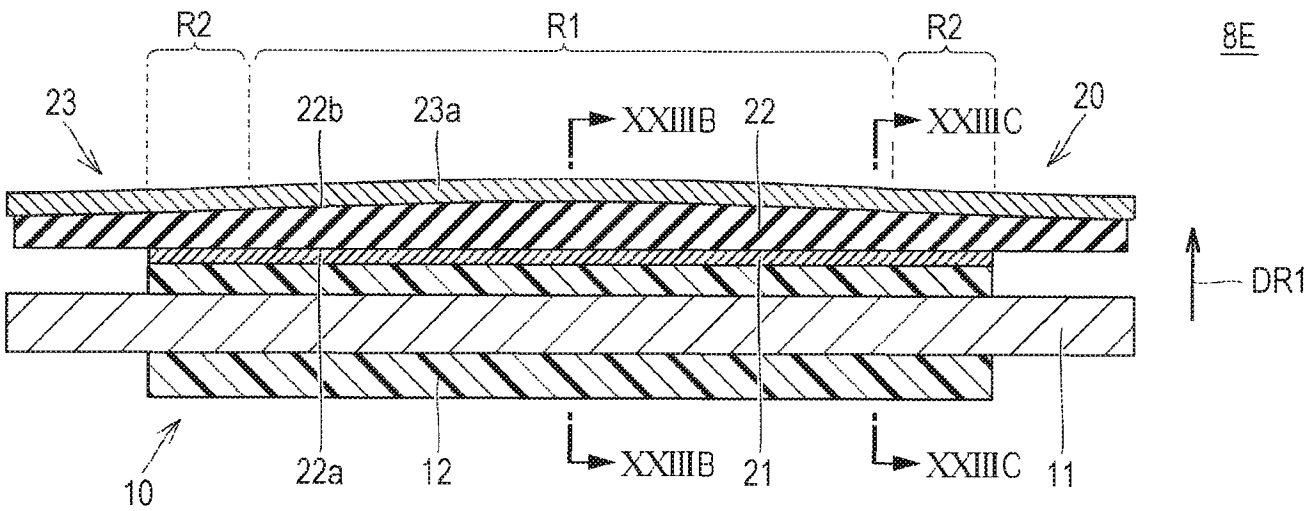
FIGS. 23A to 23C are schematic cross-sectional views illustrating a state of the fixing device according to the fifth embodiment during fixing operation.
Figure 23B:
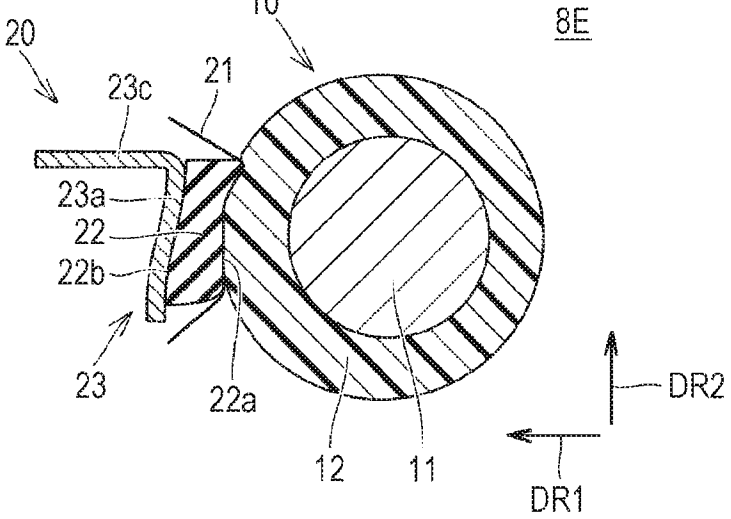
Figure 23C:
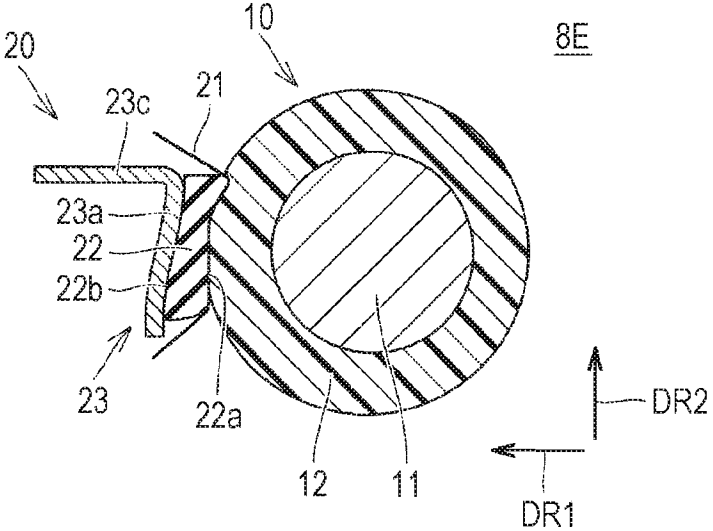

FIG. 21 is a schematic view illustrating a shape of each of a pressure pad and a sandwiching member of a fixing device according to a fifth embodiment. Additionally, FIGS. 22A to 22C are schematic cross-sectional views illustrating a state of the fixing device according to the fifth embodiment during a standby period, and FIGS. 23A to 23C are schematic cross-sectional views illustrating a state thereof during fixing operation. In the following, a structure and operation of a fixing device 8E according to the present embodiment will be described with reference to FIGS. 21 and 23A to 23C. Note that the fixing device 8E according to the present embodiment is incorporated in an image forming apparatus 1 according to a first embodiment described above instead of a fixing device 8A according to the above-described first embodiment.

Here, note that FIG. 21 is a view of the pressure pad 22 and the sandwiching member 23 when respectively viewed from the pressure roller 10 side. Additionally, FIGS. 22A and 23A illustrate cross sections each traversing a center of a nip N in a conveyance direction DR2 of a sheet S described above, FIGS. 22B and 23B illustrate cross sections taken along a line XXIIB-XXIIB illustrated in FIG. 22A and a line XXIIIB-XXIIIB illustrated in FIG. 23A respectively, and FIGS. 22C and 23C illustrate cross sections taken along a XXIIC-XXIIC line illustrated in FIG. 22A and a line XXIIIC-XXIIIC illustrated in FIG. 23A respectively.

Similar to a fixing device 8D according to a fourth embodiment described above, in the fixing device 8E according to the present embodiment, a second main surface 22*b* of the pressure pad 22 is formed considering not only deflection along a width direction possibly occurring in the sandwiching member 23 but also deflection along a conveyance direction DR2 of a sheet S possibly occurring in the sandwiching member 23, and a shape of the second main surface 22*b* of the pressure pad 22 is different because of to a fact that a shape of the sandwiching member 23 differs from that in the fixing device 8D according to the above-described fourth embodiment.

As illustrated in FIGS. 21 and 22A to 22C, in the present embodiment, the sandwiching member 23 has a shape with a cross section of substantially L-shape including: a plate-like abutting part 23*a*; and a single plate-like standing wall 23*c* standing from the abutting part 23*a*. Here, the standing wall 23*c* stands from an end of the abutting part 23*a* corresponding to a downstream position in the conveyance direction DR2 of a sheet S, and the standing wall 23*c* functions as a reinforcing rib.

Therefore, in a pressed state in which the pressure pad 22 is pressed by a pressure roller 10, the sandwiching member 23 is defected not only along the width direction but also along the conveyance direction DR2 of a sheet S. Due to such deflection, an area included in the abutting part 23*a* and located on the upstream side in the conveyance direction DR2 of a sheet S is displaced larger than an area included in the abutting part 23*a* and located on the downstream side in the conveyance direction DR2 of a sheet S.

As illustrated in FIGS. 21 and 22A to 22C, in the fixing device 8E according to the present embodiment, a surface of the abutting part 23*a* of the sandwiching member 23 facing the second main surface 22*b* of the pressure pad 22 is formed flat, whereas the second main surface 22*b* of the pressure pad 22 has a predetermined curved shape.

More specifically, similar to the case of the above-described first embodiment, in a state in which the pressure pad 22 is not pressed by the pressure roller 10 (i.e., standby state), a width-direction center of an area included in the second main surface 22*b* and corresponding to a sheet passing region R1 provided in the nip N has a shape bulging toward the abutting part 23*a* side of the sandwiching member 23 more than width-direction both ends of the area included in the second main surface 22*b* and corresponding to the sheet passing region R1 provided in the nip N. Note that the second main surface 22*b* of the pressure pad 22 has a positive crown shape described above.

Additionally, in the state in which the pressure pad 22 is not pressed by the pressure roller 10 (i.e., standby state), an area included in the second main surface 22*b*, located on the upstream side in the conveyance direction DR2 of a sheet S, and corresponding to the sheet passing region R1 provided in the nip N has a shape bulging toward the abutting part 23*a* side of the sandwiching member 23 more than an area included in the second main surface 22*b*, located on the downstream side in the conveyance direction DR2 of a sheet S, and corresponding to the sheet passing region R1 provided in the nip N. In other words, different from the above-described first embodiment, the second main surface 22*b* of the pressure pad 22 is structured such that a bulging amount of the area included in the second main surface 22*b* and corresponding to the sheet passing region R1 provided in the nip N become nonuniform in the conveyance direction DR2 of a sheet S.

Here, by appropriately setting the bulging amount of the above-described second main surface 22*b* of the pressure pad 22, displacement caused by deflection of the sandwiching member 23 can be absorbed not only in the width direction but also in the conveyance direction DR2 of a sheet S by the bulging part provided on the second main surface 22*b* side of the pressure pad 22. Accordingly, as a result, deflection of the pressure pad 22 can be suppressed while an entire region of an area included in the second main surface 22*b* and corresponding to the sheet passing region R1 provided in the nip N is made to closely contact the abutting part 23*a*. Consequently, it is possible to substantially uniformly apply pressure to a sheet S along an axial direction of the pressure roller 10 (i.e., width direction of the fixing belt 21) in the sheet passing region R1 of the nip N, and furthermore, pressure distribution along the conveyance direction DR2 of a sheet S at the nip N can be appropriately controlled.

Therefore, with this structure, a toner image can be uniformly fixed in the entire region in the width direction of the nip N, the pressure distribution along the conveyance direction DR2 of a sheet S at the nip N can be appropriately controlled, fixability and separability can be improved, and quality of a formed image can be greatly improved as a result thereof.

[Others]

The above-described characteristic structures described in the first to fifth embodiments and modified examples thereof can be obviously combined with each other within a range not departing from the gist of the present invention.

Additionally, in the above-described first to fifth embodiments and modified examples thereof, the description has been provided by exemplifying the case where the present invention is applied to a so-called tandem-type color printer employing an electrophotographic system and to the fixing device provided therein, however; the present invention is not limited to thereto and the present invention can be applied to various kinds of image forming apparatuses that adopt the electrophotographic system and a fixing device provided in any one of the image forming apparatuses.

Although embodiments of the present invention have been described and illustrated in detail, the disclosed embodiments are made for purposes of illustration and example only and not limitation. The scope of the present invention should be interpreted by terms of the appended claims, and includes all modifications within the meaning and scope equivalent to the description in the scope of the claims.

What is claimed is:

1. A fixing device that fixes a toner image onto a recording material by applying heat and pressure to the toner image formed on the recording material at a nip provided in a conveyance path of the recording material, the fixing device comprising:

a heating source that heats a toner image formed on a recording material;

a pressure roller and a pressure pad arranged in a manner facing each other while interposing the conveyance path so as to form the nip; and a sandwiching member arranged on an opposite side of a side where the pressure roller is located when viewed from the pressure pad, and used to sandwich the pressure pad with the pressure roller in a pressed state in which the pressure pad is pressed by the pressure roller, wherein the pressure pad includes a first main surface located on the pressure roller side and a second main surface located on the sandwiching member side, and the first main surface is formed of a long plate-like member extending along a width direction that is a direction parallel to an axial direction of the pressure roller, the sandwiching member includes a long plate-like abutting part that extends along the width direction and abuts on the pressure pad in the pressed state, a width-direction center in an area included in the second main surface and corresponding to a recording material passing region provided in the nip bulges toward the abutting part side more than width-direction both ends of the area included in the second main surface and corresponding to the recording material passing region provided in the nip, and an entire region of the area included in the second main surface and corresponding to the recording material passing region provided in the nip closely contacts the abutting part in the pressed state.

2. The fixing device according to claim 1, wherein areas included in the second main surface, corresponding to a pair of outer regions provided in the nip, and located more on outer sides in the width direction than the recording material passing region provided in the nip respectively bulge toward the abutting part side more than width-direction both ends of the area included in the second main surface and corresponding to the recording material passing region provided in the nip.

3. The fixing device according to claim 1, wherein the pressure pad is attached to the sandwiching member.

4. The fixing device according to claim 1, further comprising a chassis to which the sandwiching member is attached, wherein the sandwiching member is supported by the chassis at both ends located on a more outer side in the width direction than the area corresponding to the recording material passing region provided in the nip.

5. The fixing device according to claim 1, wherein a surface of an area included in the abutting part and abutting on the second main surface is flat in the pressed state.

6. The fixing device according to claim 1, wherein the pressure pad includes:

a first member arranged on the pressure roller side and defining the first main surface; and a second member arranged on the sandwiching member side and defining the second main surface, and the second member is arranged in a manner aligned with the first member in a pressing direction of the pressure roller, and is fixed in a manner closely contacting the first member.

7. The fixing device according to claim 1, wherein a bulging amount of the area included in the second main surface and corresponding to the recording material passing region provided in the nip is non-uniform in a recording material conveyance direction.

8. The fixing device according to claim 7, wherein the sandwiching member further includes a standing wall standing from the abutting part toward an opposite side of a side where the pressure roller is located, and a bulging amount of an area included in the second main surface and facing the standing wall is smaller than a bulging amount of an area included in the second main surface and not facing the standing wall.

9. The fixing device according to claim 8, wherein the standing wall formed in a manner extending along the width direction is provided at only one end in the recording material conveyance direction of the abutting part.

10. The fixing device according to claim 8, wherein the standing walls formed in a manner extending along the width direction are provided in both ends in the recording material conveyance direction of the abutting part.

11. The fixing device according to claim 7, wherein the sandwiching member further includes a standing wall standing from the abutting part toward an opposite side of the side where the pressure roller is located, the standing wall formed in a manner extending along the width direction is provided in an upstream end in the recording material conveyance direction of the abutting part, and in the pressed state, the second main surface abuts on the abutting part at a more downstream position in the recording material conveyance direction than a position corresponding to the standing wall provided at the upstream position in the recording material conveyance direction.

12. The fixing device according to claim 1, wherein an end located on the downstream side in the recording material conveyance direction and included in an area that is included in the first main surface and corresponds to the recording material passing region provided in the nip protrudes toward the pressure roller side.

13. The fixing device according to claim 1, further comprising an endless fixing belt arranged in a manner passing through the nip along the recording material conveyance direction by surrounding the pressure pad while setting a direction parallel to the width direction as an axis, wherein the fixing belt is pressed against the pressure pad by the pressure roller in the pressed state and is heated by the heating source at a position other than the nip, and when the pressure roller is rotationally driven in the pressed state, the fixing belt slides on the first main surface while being rotated along with the pressure roller, and also, when a toner image formed on a recording material contacts the fixing belt at the nip in the pressed state, the toner image is heated by the fixing belt heated by the heating source.

14. The fixing device according to claim 13, wherein a low friction member that reduces frictional resistance between the pressure pad and the fixing belt is arranged in a manner covering the first main surface.

15. An image forming apparatus comprising the fixing device according to claim 1 for image formation.

* * * * *